US010418721B2

(12) United States Patent
Chattopadhyay et al.

(10) Patent No.: US 10,418,721 B2
(45) Date of Patent: Sep. 17, 2019

(54) LOW-PROFILE AND HIGH-GAIN MODULATED METASURFACE ANTENNAS FROM GIGAHERTZ TO TERAHERTZ RANGE FREQUENCIES

(71) Applicant: California Institute of Technology, Pasadena, CA (US)

(72) Inventors: Goutam Chattopadhyay, Pasadena, CA (US); Cecile D. Jung-Kubiak, Pasadena, CA (US); Theodore J. Reck, Oak Ridge, TN (US); David Gonzalez-Ovejero, Valencia (ES); Maria Alonso delPino, Pasadena, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 11 days.

(21) Appl. No.: 15/473,485

(22) Filed: Mar. 29, 2017

(65) Prior Publication Data

US 2017/0288316 A1 Oct. 5, 2017

Related U.S. Application Data

(60) Provisional application No. 62/314,829, filed on Mar. 29, 2016.

(51) Int. Cl.

| | |
|---|---|
| ***H01Q 15/02*** | (2006.01) |
| ***H01Q 21/00*** | (2006.01) |
| ***H01Q 13/20*** | (2006.01) |

(52) U.S. Cl.

CPC ..... *H01Q 21/0087* (2013.01); *H01Q 13/20* (2013.01)

(58) Field of Classification Search

CPC ..... H01Q 13/24; H01Q 9/0485; H01Q 13/06; H01Q 19/062; H01Q 19/08; H01Q 1/36; H01Q 1/38; H01Q 13/20; H01Q 13/28; H01Q 3/36; H01Q 2/0087

USPC ..... 343/756, 750, 751, 752, 852, 893

See application file for complete search history.

(56) References Cited

U.S. PATENT DOCUMENTS

| | | | | |
|---|---|---|---|---|
| 7,898,498 | B2 * | 3/2011 | Higashi | H01L 28/10 250/338.4 |
| 2004/0227668 | A1 * | 11/2004 | Sievenpiper | H01Q 13/20 343/700 MS |
| 2008/0105966 | A1 * | 5/2008 | Beer | G01S 7/032 257/690 |
| 2010/0014821 | A1 * | 1/2010 | Tokushima | B82Y 20/00 385/129 |
| 2010/0194656 | A1 * | 8/2010 | Neto | H01Q 13/28 343/781 R |

(Continued)

OTHER PUBLICATIONS

Gabriele Minatti et al. "Circular-Polarized Isoflux Anatenna based on Anisotropic Matasurface" IEEE Transactions of Antennas and Propagation, vol. 60, No. 11, Nov. 2012.*

(Continued)

*Primary Examiner* — Linh V Nguyen

(74) *Attorney, Agent, or Firm* — Gates & Cooper LLP

(57) ABSTRACT

A modulated MTS antenna including a metasurface fabricated from metallized cylinders on a ground plane. The antenna structure can be designed to operate in the Gigahertz or Terahertz frequency band and to have a well defined directivity. The MTS antenna may be micromachined out of a silicon wafer using deep reactive ion etching (DRIE).

21 Claims, 21 Drawing Sheets

(56) References Cited

U.S. PATENT DOCUMENTS

| | | | | |
|---|---|---|---|---|
| 2010/0308651 | A1* | 12/2010 | Rofougaran | H01Q 1/2283 307/11 |
| 2011/0280518 | A1* | 11/2011 | Wollack | H01P 1/00 385/50 |
| 2012/0194399 | A1* | 8/2012 | Bily | H01Q 13/28 343/772 |
| 2012/0322164 | A1* | 12/2012 | Lal | B82Y 10/00 436/501 |
| 2014/0340178 | A1 | 11/2014 | Jung-Kubiak et al. | |
| 2016/0141754 | A1* | 5/2016 | Leyh | H01Q 3/247 342/372 |

OTHER PUBLICATIONS

Gonzalez-Ovejero, D., et al., "A class of silicon micromachined metasurface for the design of high-gain terahertz antennas," Proc. IEEE AP Soc. Int. Symp., pp. 1191-1192, Fajardo, PR, Jun.-Jul. 2016.

Fong, B.H., et al., "Scalar and Tensor Holographic Artificial Impedance Surfaces", IEEE Transactions on Antennas and Propagation, Oct. 2010, pp. 3212-3221, vol. 58, No. 10.

Minatti, G., et al., "Modulated Metasurface Antennas for Space: Synthesis, Analysis and Realizations", IEEE Transactions on Antennas and Propagation, Apr. 2015, pp. 1288-1300, vol. 63, No. 4.

Chattopadhyay, G., "Technology, Capabilities, and Performance of Low Power Terahertz Sources", IEEE Transactions on Terahertz Science and Technology, Sep. 2011, pp. 33-53, vol. 1, No. 1.

Reck, T.J., et al., "Measurement of Silicon Micromachined Waveguide Components at 500-750 GHz", IEEE Transactions on Terahertz Science and Technology, Jan. 2014, pp. 33-38, vol. 4, No. 1.

Jung, C., et al., "Compact Submillimeter-wave Receivers made with Semiconductor Nano-Fabrication Technologies", Microwave Symposium Digest (MTT), 2011 IEEE MTT-S International, pp. 1-4.

Oliner, A.A., et al., "Guided Waves on Sinusoidally-Modulated Reactance Surfaces", IRE Transactions on Antennas and Propagation, Dec. 1959, pp. 201-208, vol. 7, No. 5.

King, R.J., et al., "The Synthesis of Surface Reactance Using an Artificial Dielectric", IEEE Transactions on Antennas and Propagation, May 1983, pp. 471-476, vol. AP-31, No. 3.

Silveirinha, M.G., et al., "Electromagnetic Characterization of Textured Surfaces Formed by Metallic Pins", IEEE Transactions on Antennas and Propagation, Feb. 2008, pp. 405-415, vol. 56, No. 2.

Esquius-Morote, M., et al., "Sinusoidally Modulated Graphene Leaky-Wave Antenna for Electronic Beamscanning at THz", IEEE Transactions on Terahertz Science and Technology, Jan. 2014, pp. 116-122, vol. 4, No. 1.

Bilow, H.J., "Guided Waves on a Planar Tensor Impedance Surface", IEEE Transactions on Antennas and Propagation, Oct. 2003, pp. 2788-2792, vol. 51, No. 10.

Gonzalez-Ovejero, D., et al., "Gaussian Ring Basis Functions for the Analysis of Modulated Metasurface Antennas", IEEE Transactions on Antennas and Propagation, Sep. 2015, pp. 3982-3993, vol. 63, No. 9.

Federici, J., et al., "Review of terahertz and subterahertz wireless communications", Journal of Applied Physics, 2010, pp. 111101-1-11101-22, vol. 107.

Kleine-Ostmann, T., et al., "A Review on Terahertz Communications Research", J Infrared Milli Terahz Waves, 2011, pp. 143-171, vol. 32, No. 2.

Song, H-J, et al., "Present and Future of Terahertz Communications", IEEE Transactions on Terahertz Science and Technology, Sep. 2011, pp. 256-263, vol. 1, No. 1.

Ducournau, G., et al., "THz Communications using Photonics and Electronic Devices: the Race to Data-Rate", J. Infrared Milli Terahz Waves, 2015, pp. 198-220, vol. 36, No. 2.

Nagatsuma, T., et al., "Advances in terahertz communications accelerated by photonics", Nature Photonics, Jun. 2016, pp. 371-379, vol. 10.

Ericsson Mobility Report, on the Pulse of the Networked Society, Jun. 2016, https://www.ericsson.com/res/docs/2016/ericsson-mobility-report-2016.pdf, as downloaded Jul. 21, 2017.

Aguiar, R. et al., "White Paper for Research Beyond 5G", Networld, Jan. 7, 2016, http://networld2020.eu/wp-content/uploads/2016/03/B5G-Vision-for-Researchv-1.1b_final-andapproved.pdf, Oct. 2015, as downloaded on Jul. 21, 2017.

Moeller, L., et al., "THz and IR Signaling through Fog Scintillations", European Wireless 2012, Apr. 18-20, 2012, Poznan, Poland, pp. 1-5.

Task Group 3d 100 Gbit/s Wireless TG 3d (100G); http://www.ieee802.org/15/pub/index_TG3d.html, as downloaded on Sep. 18, 2017.

* cited by examiner

Isotropic
Anisotropic 7m
4λ
4λ
LHCP $\phi = 0$
LHCP $\phi = \pi/2$
RHCP $\phi = 0$
RHCP $\phi = \pi/2$
Gain [dB]
Theta [degrees]

LOW-PROFILE AND HIGH-GAIN MODULATED METASURFACE ANTENNAS FROM GIGAHERTZ TO TERAHERTZ RANGE FREQUENCIES

CROSS REFERENCE TO RELATED APPLICATIONS

This application claims the benefit under 35 U.S.C. Section 119(e) of commonly-assigned U.S. Provisional Patent Application Ser. No. 62/314,829, filed on Mar. 29, 2016, by Goutam Chattopadhyay and David Gonzalez-Overjero, entitled "LOW-PROFILE AND HIGH-GAIN MODULATED METASURFACE ANTENNAS FROM GIGAHERTZ TO TERAHERTZ RANGE FREQUENCIES", which application is incorporated by reference herein.

STATEMENT REGARDING FEDERALLY SPONSORED RESEARCH AND DEVELOPMENT

The invention described herein was made in the performance of work under a NASA contract NNN12AA01C, and is subject to the provisions of Public Law 96-517 (35 USC 202) in which the Contractor has elected to retain title.

BACKGROUND OF THE INVENTION

1. Field of the Invention

The present invention relates to antennas.

2. Description of the Related Art (Note: This application references a number of different publications as indicated throughout the specification by one or more reference numbers in brackets, e.g., [x]. A list of these different publications ordered according to these reference numbers can be found below in the section entitled "References." Each of these publications is incorporated by reference herein.)

Modulated metasurface (MTS) [1], [2] antennas have recently sprung up as a versatile solution for deep space communications [2]. Indeed, modulated MTSs can be applied to the design of high to very-high gain antennas. Among their advantages it is worth noting their capability of beam shaping, pointing and scanning, a simple on-surface control of the aperture fields, and all this while keeping a low profile and low envelope. The latter two features are particularly appealing for spaceborne communication systems and science instruments.

In MTS antennas, an inductive surface reactance supports the propagation of a (dominantly) transverse magnetic (TM) surface-wave (SW), which is gradually radiated.

Radiation is achieved by periodically modulating the equivalent reactance on the antenna aperture. The interaction between the SW and the periodic modulation makes the (−1) indexed Floquet mode enter the visible region, thus becoming a radiating mode. The surface reactance modulation is typically achieved at microwave frequencies by changing the size and orientation of sub-wavelength patches printed on a grounded dielectric substrate, and arranged in a periodic lattice [1], [2]. MTSs made of printed patches are normally excited by a coaxial cable with capacitive loading for an improved matching.

However, despite the good performance shown by artificial surfaces implemented with sub-wavelength patches at frequencies below 100 GHz, there are some aspects which hinder the use of this approach in the terahertz (THz) range. First, the losses in the dielectric become, in most applications, a limiting factor and all-metal structures are preferred. Second, it is challenging to combine a coaxial SW launcher with the rectangular waveguide (RW) output of solid-state frequency-multiplied continuous-wave sources, which are the most commonly used sources at THz frequencies [3]. The conversion of the RW transverse electric (TE) TE10 mode to the coaxial transverse electromagnetic (TEM) mode requires a long coaxial section, which implies large diameter/height ratios of the coaxial inner conductor. Hence, such feeding topologies will be mechanically unstable without any dielectric support and all-waveguide solutions are pursued.

SUMMARY OF THE INVENTION

The present disclosure demonstrates the unexpected suitability of (e.g., silicon) micromachining for the realization of modulated MTS antennas at millimeter and sub-millimeter wavelengths. Illustrative embodiments of the modulated MTS antennas in the THz range comprise a pillar structure (e,g. a bed of nails MTS) made of cylinders with square, circular, or elliptical cross-sections, for example. Such MTS pillar structures are particularly well-suited for being micromachined out of a semiconductor (e.g., silicon) wafer by means of deep reactive ion etching (DRIE). Thus, illustrative embodiments of the antenna structure comprise a substrate and the pillars including a semiconductor (e.g., silicon), wherein the pillars are etched onto a surface of the substrate.

The heights and one or more spacings of the pillars are designed such that the leaky wave radiating from the array has the desired frequency (e.g., in a range of 26.5 GHz-1 THz). Typically, the pillars in the pillar structure have a height up to 2000 micrometers (e.g., 20-500 micrometers), a diameter in a range of 1 micrometer-1000 micrometers (e.g., 1.5-20 micrometers), and a spacing in a range of 50 micrometers to 2000 micrometers (e.g., 100-500 micrometers). In one or more embodiments, the pillars are disposed in an array having a length and width in a range of 1 mm-1 meter (e.g., a 1 m by 1 m antenna). In further embodiments, the height of each pillar is less than 10 times a radius of the pillar.

Surprisingly, the dimensions may be selected to overcome the constraints DRIE imposes on the design as well as to achieve desired beam propagation (e.g., directivity, gain). For example, the heights may vary periodically across the array so that a surface reactance of the substrate is modulated across the array and the leaky wave radiates as a beam of electromagnetic radiation. For example, the heights may vary periodically across the array with a period in a range of 50-200 micrometers (e.g., forming square, circular, or spiral arrangements of pillars). In another example, the heights vary periodically so that a power in the beam at an angle of more than 10 degrees, from a center direction of propagation of the beam, is reduced by a factor of at least 10.

Embodiments of the invention are not limited to semiconductor based structures wherein the semiconductor in the pillars is coated with metal. In other examples, which operate in the millimeter-wave range, the substrate and the pillars are machined from a metal block so that the substrate and pillars consist essentially of metal.

One of the major advantages of the antenna embodiments described herein is that they can be used at lower frequencies for very high-gain telecommunication antennas. For example, embodiments of the modulated MTS antennas described herein can be incorporated into CubeSats and SmallSats telecommunication and terahertz receiver systems thereby revolutionizing the field of deployable antennas. Moreover, illustrative embodiments of the MTS antennas present a low-profile, low-weight, and an efficient on surface control of the aperture fields, leading to a low-level of cross-polarized fields and beam-shaping capabilities. The MTS antennas' main advantage with respect to mesh reflectors and reflectarrays lies in having the feed on the aperture plane, which eliminates the complexity associated with the feed deployment. Thus, the modulated MTS antennas described herein provide solutions that are not conventionally available for terahertz or gigahertz instrument designers.

BRIEF DESCRIPTION OF THE DRAWINGS

Referring now to the drawings in which like reference numbers represent corresponding parts throughout:

FIG. 5(*c*) illustrates a TM-SW launcher according to one or more embodiments of the present invention, which transforms the RW $TE_{10}$ mode output from the frequency multiplier/mixer to a CW $TM_{01}$ mode, which offers optimum coupling to the TM surface wave and avoids coaxial-like structures, which are the natural solution at microwave frequencies.

FIG. 5(*d*) illustrates the bend and divider response in FIG. 5*c*.

FIG. 5(*e*) illustrates the CW $TM_{01}$ mode in FIG. 5*c*.

FIG. 5(*f*) is a scanning electron microscope (SEM) image showing detail of the E-plane bend and the input of the H-plane power divider according to one or more embodiments.

FIG. 5(*g*) and FIG. 5(*h*) are SEM images showing one of the two symmetrical RW branches and the steps in the Chebyshev-like matching network, according to one or more embodiments.

FIG. 5(*i*) shows $S_{11}$ at the input RW port of the antenna, according to one or more embodiments of the present invention.

FIG. 6(*b*) illustrates the variation of the Zxy element of the impedance tensor with the height and orientation of the elliptical cylinder, according to one or more embodiments of the present invention ($Z_{xy}=jX_0M\sin(\beta_{sw}\rho)$).

FIG. 7(*b*) illustrates ideal values of a sinusoidal modulation of the impedance tensor, and values retrieved using the proposed metasurface based on elliptical cylinders, according to one or more embodiments of the present invention.

FIG. 8(*b*) illustrates RHCP fields radiated by the metasurface in FIG. 8.

FIG. 9(*e*) illustrates Right-handed circular polarized (RHCP) and lefthanded circular polarized (LHCP) gain patterns at 300 GHz plotted with solid and dashed lines, respectively, on two orthogonal cuts, for the spiral antenna structure of FIG. 5(*a*).

FIG. 9(*f*) illustrates magnitude of the S11 in dB at the input RW port of the antenna, HFSS (solid) and CST (dots) simulation results of the antenna structure in FIG. 5(*a*).

FIG. 9(*g*) illustrates surface reactance at 550 GHz as a function of the height of the cylinder, according to one or more embodiments, wherein the cylinder radius is r=12.5 μm and the side of the unit cell is a=86.8 μm. The inset shows the isofrequency dispersion curves for an elliptical cylinder in the same unit cell.

FIG. 9(*h*) illustrates directivity pattern at 550 GHz for a row of cylinders modulated according to (1) with $\overline{X}=0.7\zeta$ and M=0.65. The insets show the E-field intensity in the y=0 plane and the attenuation of the SW due to radiation.

DETAILED DESCRIPTION OF THE INVENTION

Figure 1:
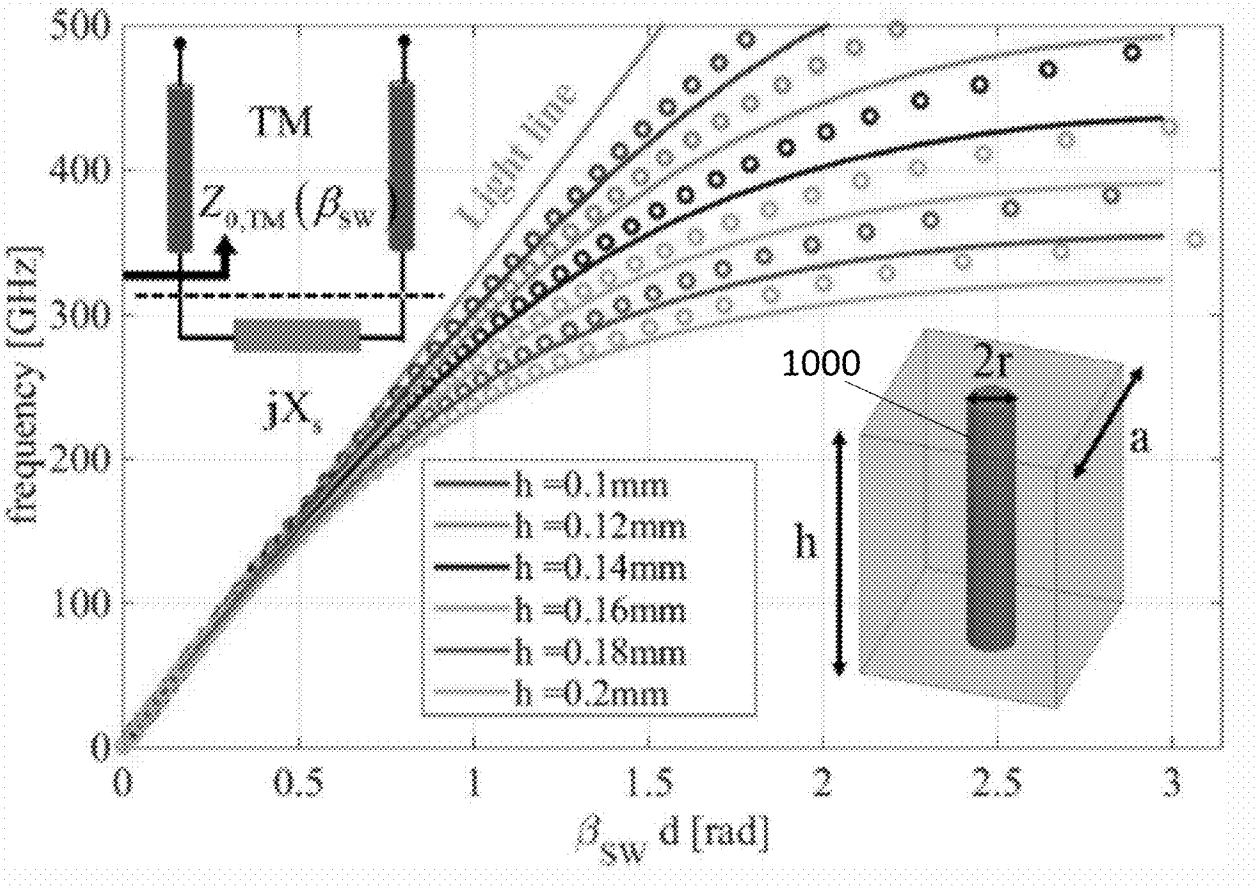
FIG. 1 illustrates dispersion diagrams for different heights of the metallic cylinders, r=17.5 μm and the side of the square unit cell is a=147 μm, according to one or more embodiments of the present invention. The solid lines have been obtained using the eigenmode solver in [9]. The circular markers are the solution of (3) for the reactance given in (6).

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Technical Description

An MTS antenna at terahertz frequencies can be implemented using a pillar structure comprising either circular or elliptical cylinders. By changing the height, orientation, and axial ratio of the elliptical cylinders, the surface waves that propagate through the pillar structure. In addition, the pillar structure may be designed such that the cylindrical rods are not too long and their heights are varied across the antenna to modulate the surface waves in appropriate ways. In illustrative embodiments, the antennas are fabricated on silicon wafers using deep reactive ion etching (DRIE) process.

Design of Sinusoidally Modulated Reactance Surfaces

A SW is transformed into a leaky-wave (LW) by appropriately modulating a surface reactance. Let us first consider a one-dimensional modulation on the z=0 plane and no variation in the y direction. The corresponding sinusoidal inductive reactance can be written as $$X_s(x) = \overline{X}\left(1 + M\sin\left(\frac{2\pi}{d}x\right)\right) \tag{1}$$

where $\overline{X}$ is the average surface reactance, M is the modulation factor and d is the period of the modulation. This case was studied by Oliner and Hessel in [6]. The solution to the periodic problem consists of an infinite series of Floquet modes, the transverse-to-z wavenumber for the n-indexed mode is $$k_{t,n} = \beta_{sw} + \beta_\Delta - j\alpha + \frac{2\pi n}{d} \tag{2}$$

where $\beta_\Delta$ and $\alpha$ are perturbations in the phase and attenuation constants, respectively, which depend on $\overline{X}$, M and d. In turn, $\beta_{sw}$ stands for the unperturbed value of $k_t$ (M=0), obtained by imposing the transverse resonance condition between j $\overline{X}$ and the free-space TM impedance $$j\overline{X}+Z_{0,TM}=0 \tag{3}$$

Looking for SWs $\beta_{sw}>k$ and $Z_{0,TM}=$ $$-\zeta\sqrt{\beta_{sw}^2-k^2}/k$$

with k and $\zeta$ being the free-space wavenumber and impedance, respectively and solving for $\beta_{sw}$ in (3) gives $$\beta_{sw}=k\sqrt{1+(X/\zeta)^2}.$$

When $|\Re\{k_{t,n}\}|<k$, the corresponding mode enters in the visible region of the spectrum, and it can be identified as a LW solution. The n=−1 mode is the dominant leaky-mode, and it radiates in a direction given by $$\beta_{sw}+\beta_\Delta-2\pi/d=k\sin\theta_0 \tag{4}$$

where $\theta_0$ is the angle with respect to the z axis. Consequently, the values of $\overline{X}$ and d required for a single beam directed at an angle $\theta_0$ are related using $$\beta_{sw}=k\sqrt{1+(\overline{X}/\zeta)^2}$$

in (4). For instance, one can generate a single forward beam using a period d $$d/\lambda+1/(\sqrt{1+(\overline{X}/\zeta)^2}-\sin\theta_0) \tag{5}$$

when $$\overline{X}/\zeta>\sqrt{4\sin\theta_0(1+\sin\theta_0)}.$$

In the derivation of (5), the effect of $\beta_\Delta(<<\beta_{sw})$ has been neglected.

Constituent Elements for THz MTSs

In one embodiment, the proposed MTS consists of a periodic array of metallic cylinders arranged in a square lattice, and placed on a ground plane. Such structure, which resembles a Fakir's bed of nails, has been used in the past for synthesizing artificial surfaces of inductive nature [7]. Starting from the reflection coefficient for an impinging TM wave derived in [8, eq. 4] for a bed of nails of uniform height, one can write the equivalent MTS surface reactance as $$X=\zeta(1-\xi)\tan(kh)-\xi\alpha_{TM}\tan h(\alpha_{TM}h \tag{6}$$

where $h$ is the height of the cylindrical pins, $$\xi=\beta_{sw}^2/(\beta_p^2+\beta_{sw}^2),$$

and $$\alpha_{TM}=\sqrt{\beta_p^2+\beta_{sw}^2-k^2}.$$

The parameter $\xi$ accounts for the power coupled to the TEM mode in the bed of nails, which can be also excited by the incoming TM wave. On the other hand, $\alpha_{TM}$ is the propagation (attenuation) constant [8] of the TM mode in the wired medium. Finally, $\beta_p$ is the "plasma wavenumber" [8, eq. 2]

$$\beta_p = \frac{1}{a}\sqrt{\frac{2\pi}{\ln\left(\frac{a}{2\pi r}\right)+0.5275}} \tag{7}$$

where r is the radius of the cylinder and a the side of the square lattice. The parameter $\beta_p$ accounts for the spatial dispersion in the wired medium.

The expression in (6) represents the bed of nails as a continuous medium, and it is valid when the aspect ratio h/a>>1 [8]. The parameter a in a modulated MTS is given by a=d/N, where N is the number of unit cells used to represent one period, and it depends on $\overline{X}$ and d and $\theta_0$. One could try to make h arbitrarily long to satisfy h/a>>1.

Unfortunately, long cylindrical rods are difficult to realize with DRIE while keeping a good precision and a simple process. Therefore, upon choosing $\overline{X}$ and d and N, one has to verify that the required heights satisfy h/r≤10 before proceeding with the design.

Figure 2:
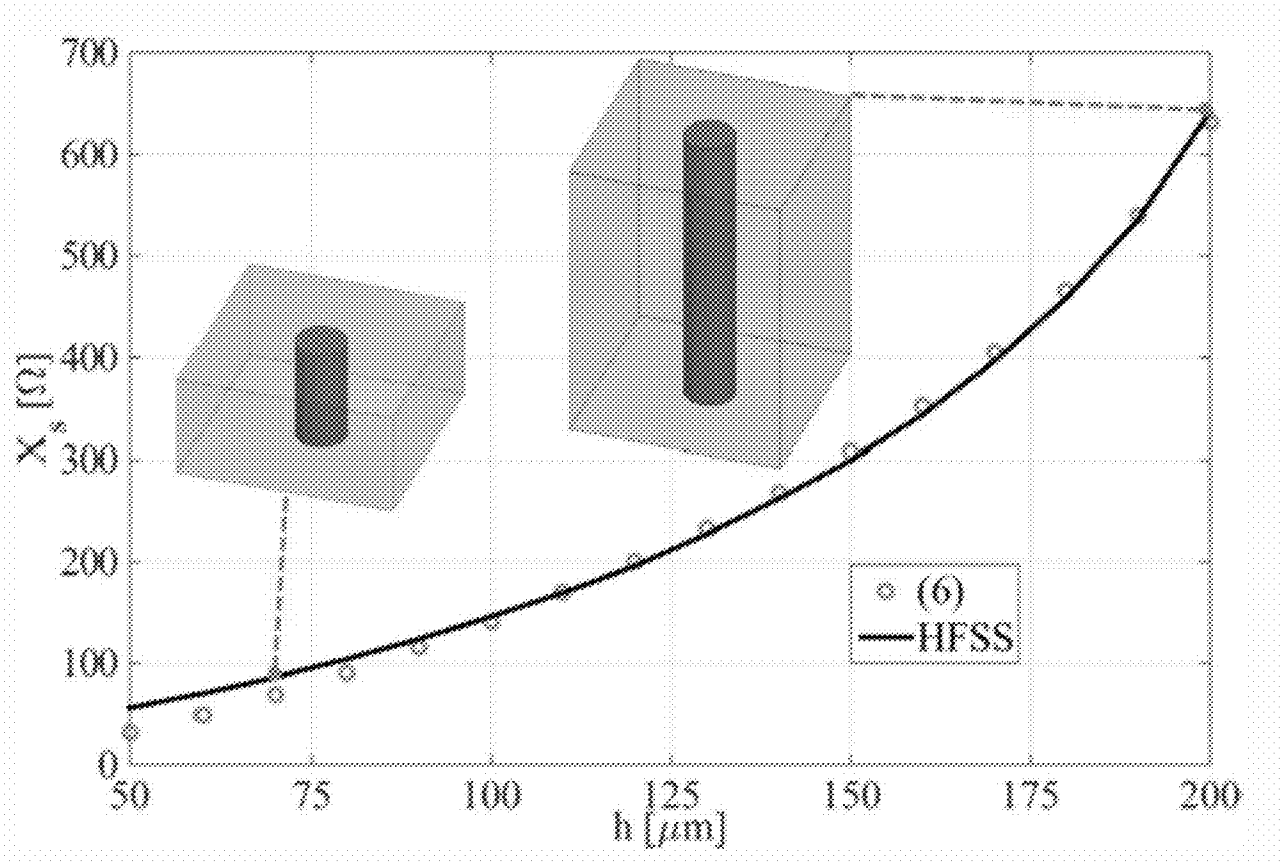
FIG. 2 shows surface reactance at 300 GHz as a function of the height of the cylinder, according to one or more embodiments of the present invention. The cylinder radius is r=17.5 μm and the side of the unit cell is a=147 μm. The solid line represents the values obtained solving (3) for the frequency $-\beta_{sw}$ pairs obtained with a full-wave eigenmode solver [9]. The circular markers have been obtained using (6).

FIG. 1 shows the dispersion curves corresponding to metallic cylinders of different heights, with r=17.5 μm and fixed side a of the square lattice. The period d has been computed at 300 GHz using (5) for an average impedance $\overline{X}$ and d=0.7$\zeta$, a forward beam pointing at $\theta_0$=5° and N=6, which implies a=147 μm. The solid curves in FIG. 1 have been obtained with the eigenmode solver of a commercial software [9], whereas the points have been computed imposing (3) between X in (6) and the TM free-space impedance (see equivalent circuit in the inset). Since h/a≤1.4, the agreement between the analytical approximation and the full-wave solution is not very good. Nevertheless, if one compares the retrieved surface reactances (shown in FIG. 2), the analytical approximation is still valid for a significant range of heights h. Therefore, the homogenization approach has to be used with caution when designing this type of modulated MTS antenna.

A major advantage of DRIE is that one can choose to etch complex cross-sections. This feature can be exploited to synthesize anisotropic surface reactances, which provide additional degrees of freedom for controlling the aperture fields' polarization [1, Sec. IV][2, Sec. V]. Other novel approaches to the design of modulated MTS antennas in the THz range, like graphene [10], do not offer this capability and micromachined textured surfaces have an edge in this respect.

Figure 3:
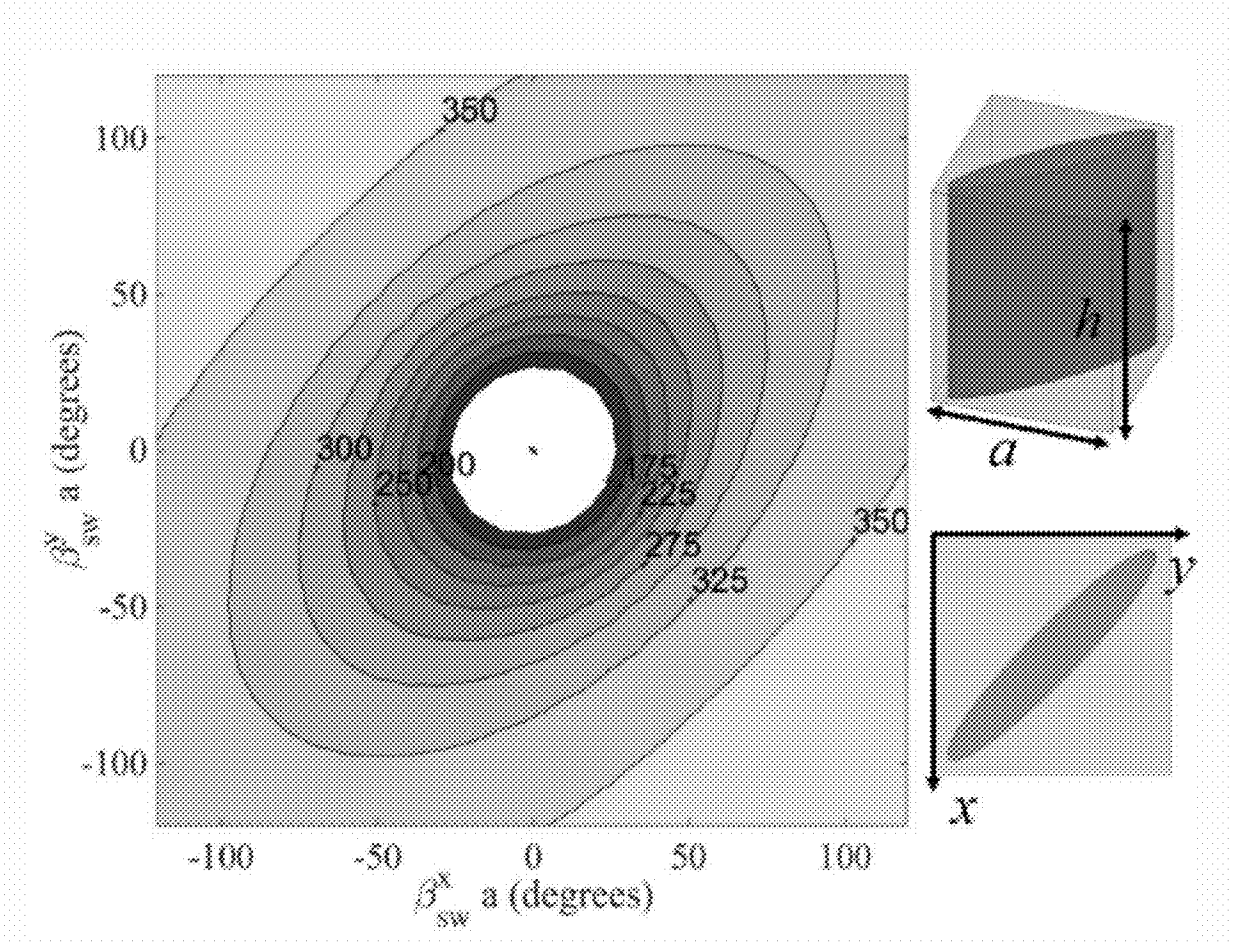
FIG. 3 shows isofrequency dispersion contours for the unit cell depicted in the insets, according to one or more embodiments of the present invention. The unit cell's side is a=138.5 μm, the height of the cylinder is h=180 μm, and the elliptical cross-section has minor axis equal to 30 μm and axial ratio equal to 4.

In general, the surface reactance is a tensor, which depends on the transverse wave vector $$\underline{\beta}_{sw}=\beta_{sw}^{x}\hat{x}+\beta_{sw}^{y}\hat{y}$$

and relates the transverse electric and magnetic fields (evaluated at the upper interface) as $$\vec{E}_t|_{z=0^+}=j\underline{\underline{X}}_S\cdot\hat{z}\times\vec{H}_t|_{z=0^+} \tag{8}$$

where $$\underline{\underline{X}}_S=[[X_{xx}X_{yx}]^T[X_{xy}X_{yy}]^T]$$

is defined in Cartesian coordinates, and $\hat{z}$ is the normal to the MTS plane. Nevertheless, for an electrically small constant period, the surface reactance of a unit cell with rotational symmetry order higher than two (circular or square cross-sections) is scalar (1). This is not the case for cylinders of elliptical cross section, which will provide a different response when the SW wave vector is aligned with each of the two symmetry axes of the ellipse. FIG. 3 shows the isofrequency dispersion ellipses for an elliptical cylinder with minor axis equal to 30 μm and axial ratio equal to 4, in a square unit cell with side a=138.5 μm. The unit cell possesses two orthogonal symmetry axes, which principal directions can be identified, in the low frequency regime, with the principal axes of the dispersion ellipse. The surface reactance tensor at a given frequency can be retrieved from the corresponding isofrequency dispersion ellipse by fitting, in the least square sense, the simulated data with [11, eq. 19]

$$(1+X_{xx}X_{yy}-X_{xy}X_{yx})kk_z+(X_{xy}+X_{yx})\beta_{sw}^{x}\beta_{sw}^{y}+[(X_{xx}+X_{yy})k^2-X_{xx}(\beta_{sw}^{y})^2-X_{yy}(\beta_{sw}^{x})^2]=0$$

where $$k_z=\sqrt{(\beta_{sw}^{x})^2+(\beta_{sw}^{y})^2-k^2}.$$

For instance, the case pictured in FIG. 3 represents an artificial tensor surface with $$\underline{\underline{X}}_S=\zeta[[1.04,0.46]^T[0.46,1.03]^T].$$

By changing the height, orientation and axial ratio of the elliptical cylinders, each component of the tensor will undergo a different modulation. Elliptical sections can be used to obtain an anisotropic response. This feature can be exploited to drastically reduce the level of the cross-polarized farfield components [2, Sec. 2] [12].

Design Examples

Figure 4:
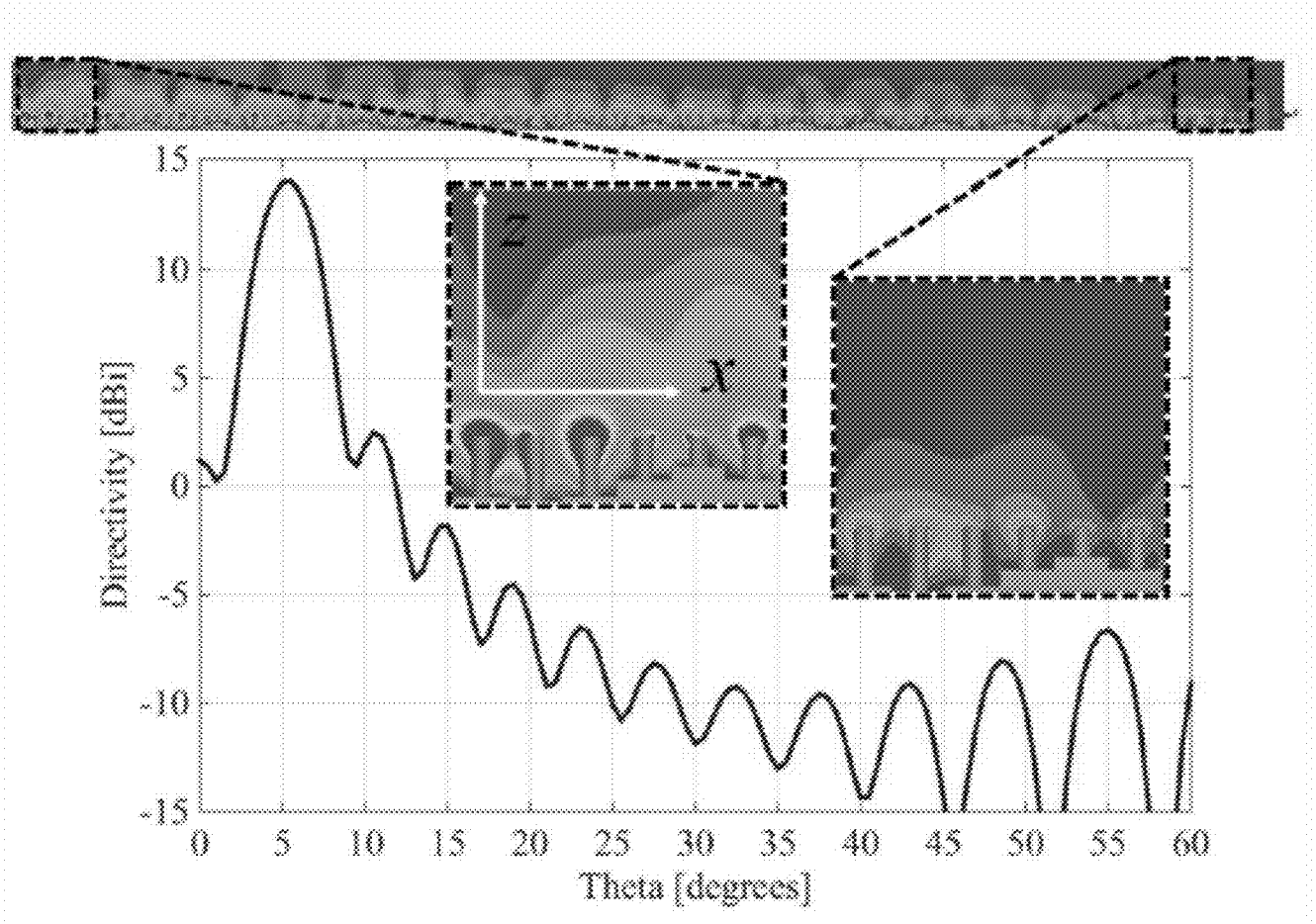
FIG. 4 is a directivity pattern for a row of cylinders modulated according to (1) with =0.7ζ and M=0.6, according to one or more embodiments of the present invention. The insets show the E-field intensity in the y=0 plane and the attenuation of the SW due to radiation.

The first example presents a verification of the theory described above. The simulation consists of a row of cylindrical rods oriented along x. The surface reactance has been modulated according to (1) with $\overline{X}=0.7\zeta$ and M=0.6, and the design frequency is 300 GHz. The value of d at this frequency for the modulation above and a pointing angle $\theta_0=5°$ is d=882 μm. For N=6, one has a=d/N=147 μm. The total length of the row is 15d. Full-wave results from an eigenmode solver (see FIG. 2) or (6) can be used to obtain the height of the cylinder that one needs to realize the surface reactance at each unit cell. The structure is excited by a wave port with vertical electric field, and the row of cylinders is sandwiched by two perfect magnetic planes to maintain a field distribution that supports the TM SW. FIG. 4 shows the directivity pattern of the structure obtained with HFSS [9], this results confirms the presence of a beam pointing in the desired direction. On the other hand, one can see in the insets the effect of the SW attenuation as it gets radiated along the structure.

Figure 5A:
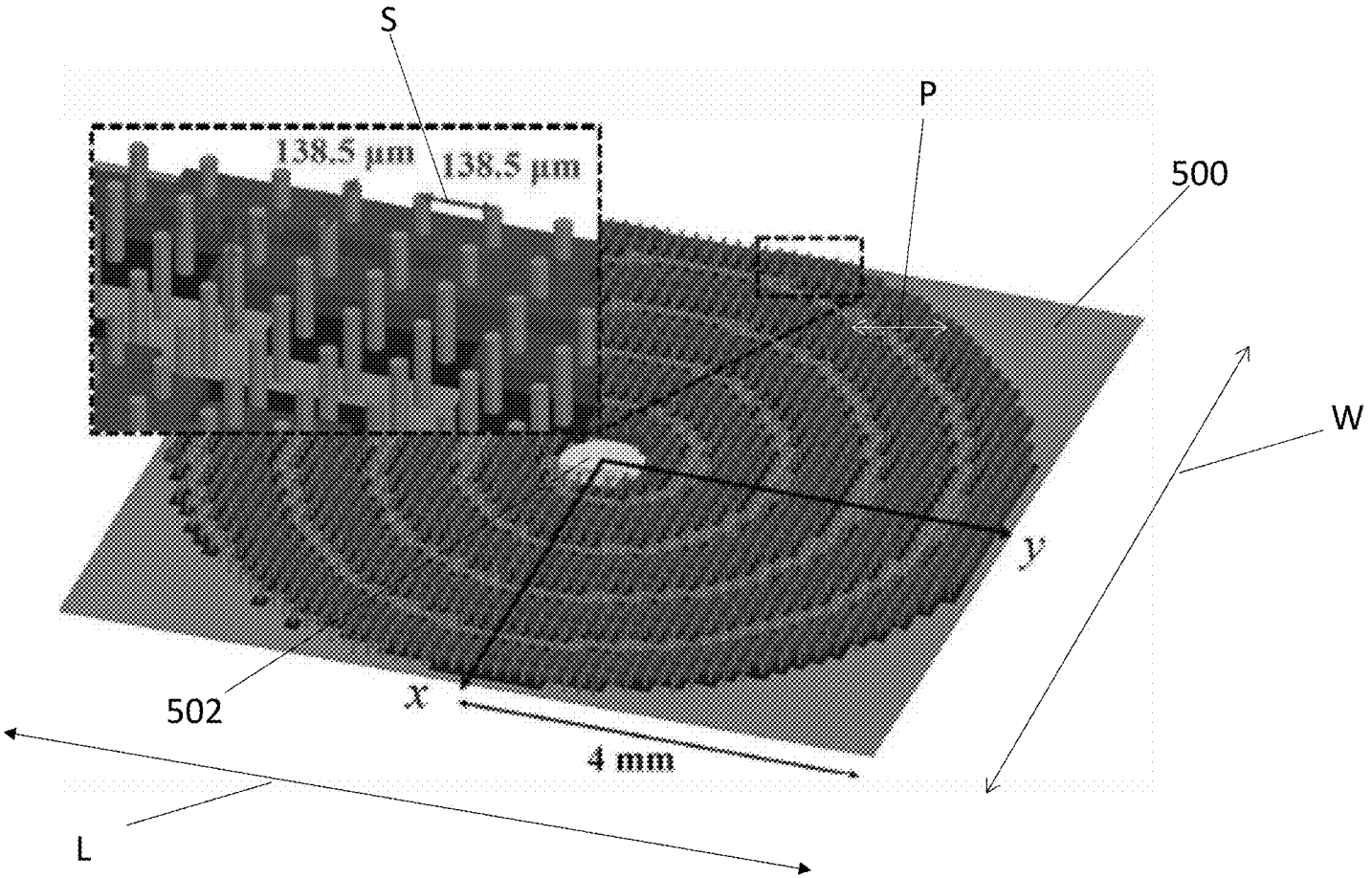
FIG. 5*a* illustrates a simulated spiral modulated MTS antenna, according to one or more embodiments of the present invention. Each color represents a different height of the cylinder. The variation of the cylinder's height provides the desired modulation of the surface impedance.
Figure 5B:
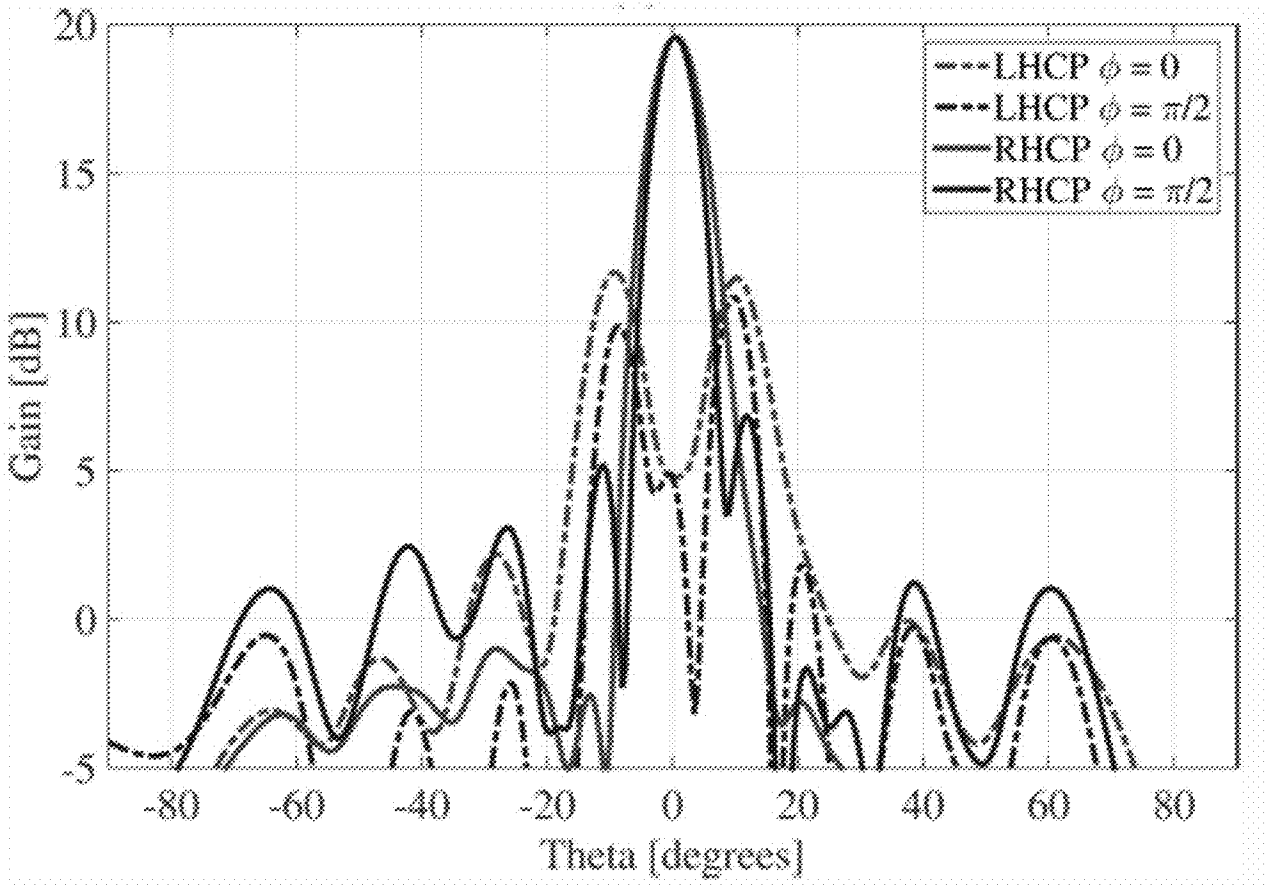
FIG. 5(*b*) shows a right-handed circular polarized (RHCP) and left-handed circular polarized (LHCP) gain patterns at 300 GHz plotted with solid and dashed lines, respectively, on two orthogonal cuts, according to one or more embodiments of the present invention.

The second example consists of a spiral modulated MTS antenna. The spiral has been designed at 300 GHz and it provides a broadside pencil beam with circular polarization. The synthesized surface reactance is $$X_s(x)=\overline{X}\left(1+M\sin\left(\frac{2\pi}{d}\rho-\phi\right)\right) \tag{9}$$

where ρ and ø represent the position on the MTS plane in polar coordinates. See [2, Sec. IV-A] for further details. In the present example, $\overline{X}=0.7\zeta$, M=0.65, N=6, and a=138.5 μm. The periodicity of the modulation along each radius is equal to $\lambda_{sw}=2\pi/\beta_{sw}\approx2\pi/\beta_0=\lambda_0$. Therefore, two SW rays separated by 90° intercept a spiral line Xs (ρ,φ)=constant at distances from the origin that differ $\lambda_{sw}/4\approx\lambda_0/4$. Thus, two sectors separated by 90° give rise to orthogonal and quadrature-phased components, which results in a broadside circular polarization. The 4 mm radius aperture is discretized in square unit cells with side a, and the heights of the cylinders in each unit cell are obtained using (9) and the data in FIG. 2. The structure is shown in FIG. 5*a*, where each color represents a different height of the metallic cylinders 1000. The pillars have spacing S and periodicity having a period P The far-field gain patterns have been computed with HFSS [9] and are shown in FIG. 5*b* for two orthogonal planes. The structure is fed with a overmoded circular waveguide with only the $TM_{01}$ mode propagating (this mode provides an efficient excitation of the TM surface wave on the MTS plane) while avoiding the use of a coaxial feed. The feeder (not shown here) is placed underneath the MTS and it transforms the $TE_{10}$ mode in the input RW to the $TM_{01}$ in the CW.

Figures 5C, 5D, 5E:
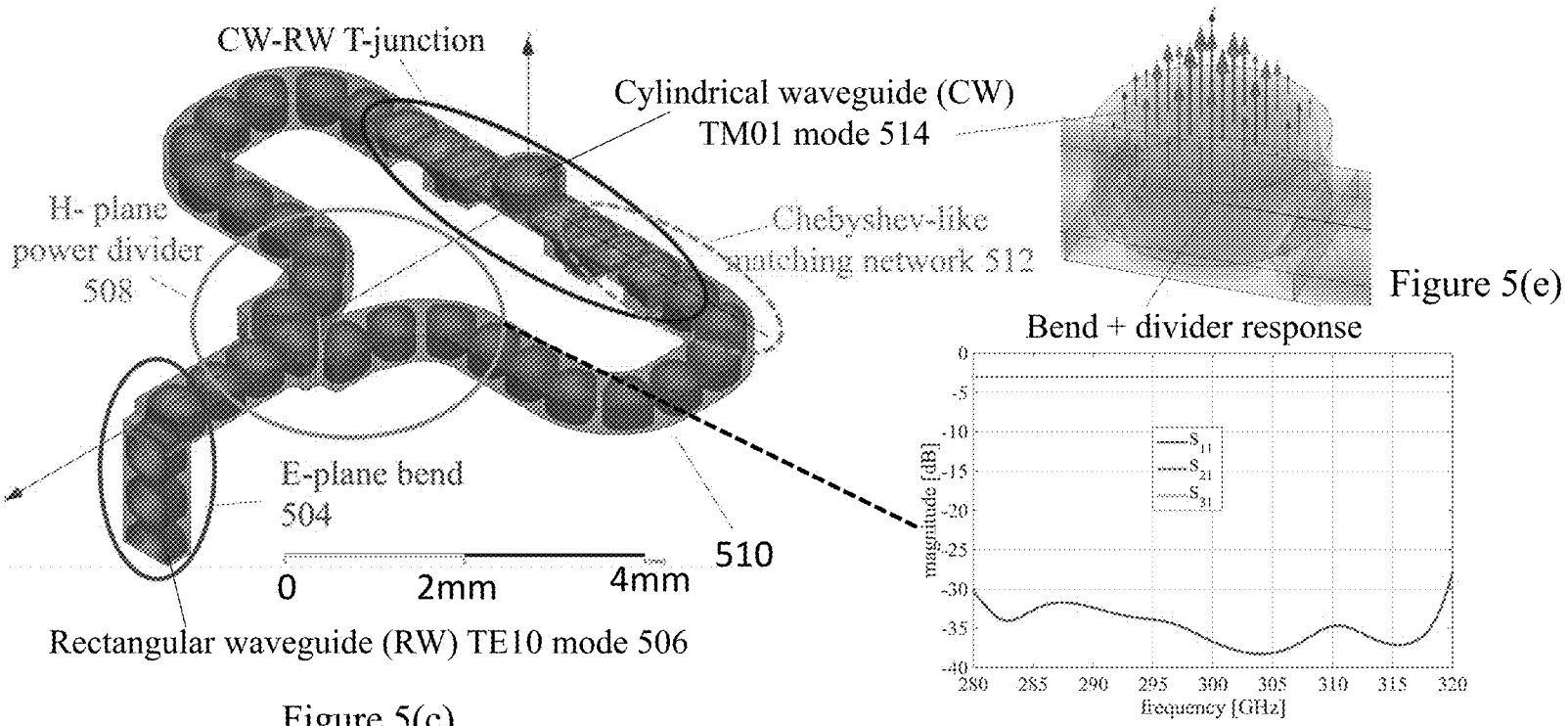

FIG. 5*c* illustrates a feeder comprising:

- an E-plane bend 504, used to adapt the standard rectangular waveguide (RW) flange to the horizontal architecture of the feed, wherein a RW TE10 mode 506 is inputted;
- an H-plane power divider 508, which divides equally the power at its input among the two outputs;
- two symmetrical RW branches 510, each including a Chebyshev-like (with RW sections of different heights and lengths) matching network 512, used to adapt the impedance of the MTS antenna to the impedance of the RW; and
- a T-junction 512 with two RW inputs and a circular waveguide (CW) output, which excites the desired $TM_{01}$ mode in the CW 514. The symmetric excitation of the CW with two RWs guarantees that the fundamental $TE_{11}$ mode of the CW is not excited.

FIG. 5*d* illustrates the bend and divider response and FIG. 5*e* illustrates the CW $TM_{01}$ mode.

The aforementioned architecture transforms the RW $TE_{10}$ mode input to a CW $TM_{01}$ mode, which offers optimum coupling to the TM surface wave supported by the MTS structure. Its main advantage is that it avoids coaxial-like structures, which are the natural solution at microwave frequencies. When fabricated using DRIE, this structure is etched on a second Si wafer. The upper broad wall of the RWs in the feeder is the back side of the wafer in which the MTS has been etched. The excellent surface roughness of the two Si wafers guarantees a good contact between wafers and negligible power losses due to gaps.

Figure 5F:
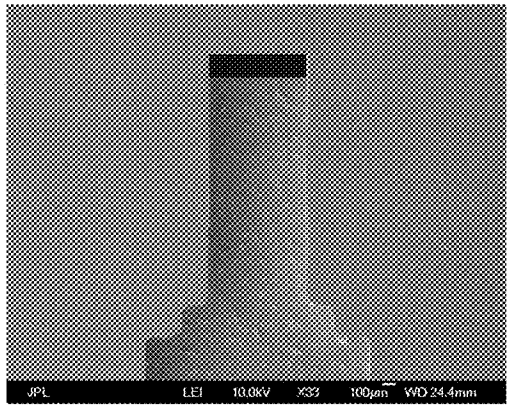
Figure 5G:
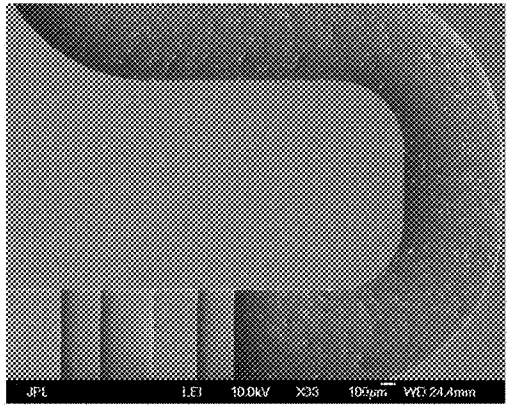
Figure 5H:
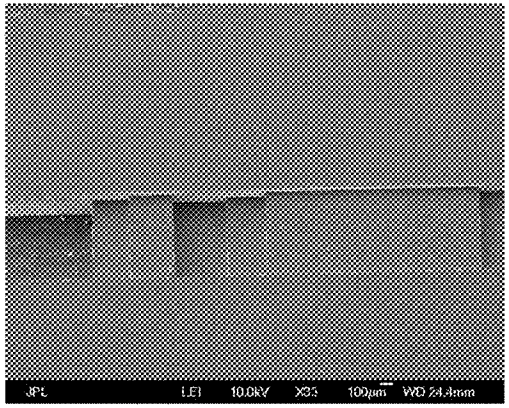

FIG. 5*f* shows a detail of the E-plane bend and the input of the H-plane power divider. FIGS. 5*g* and 5*h* show one of the two symmetrical RW branches and the steps in the Chebyshev-like matching network.

Figure 5I:
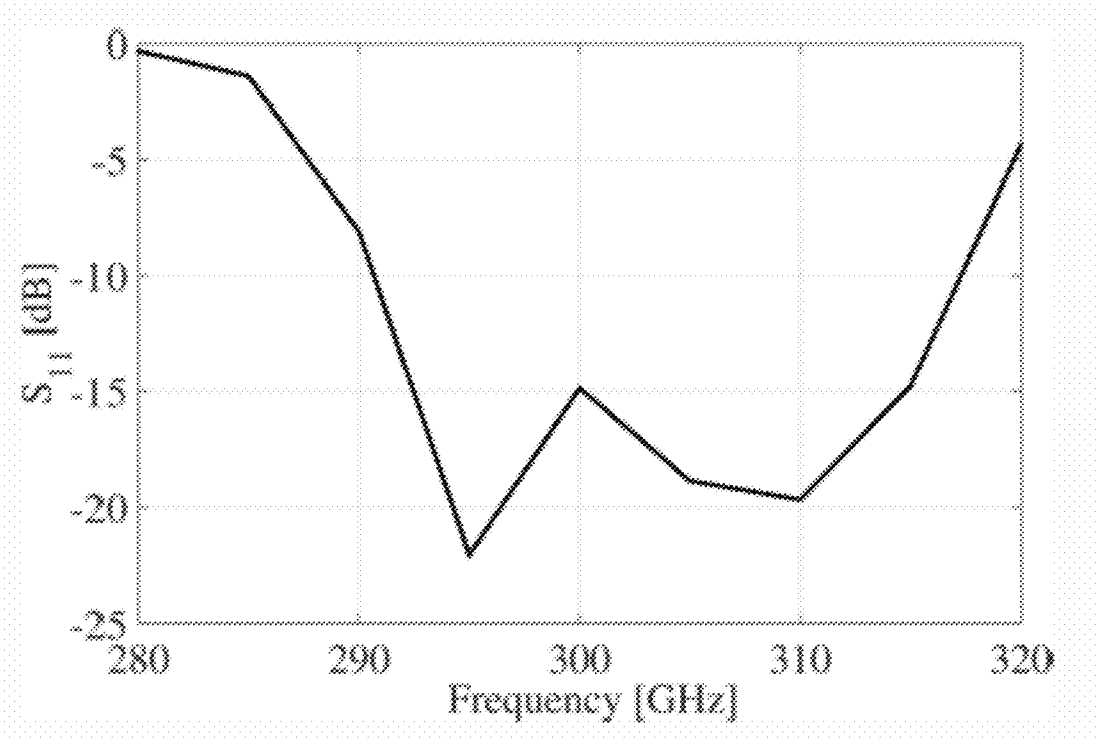

The $S_{11}$ obtained with the aforementioned feeding structure is shown in FIG. 5*i*. CST Microwave Studio and HFSS [9] have been used to simulate the antenna, the obtained results are in good agreement. The far-field gain patterns have been computed with HFSS [9] and they are shown in FIG. 9(*g*) for two orthogonal planes at 300 GHz. A similar performance has been verified for the patterns in the rest of the 290-315 GHz band.

Further Results for Pillar Structures Comprising Elliptical Cylinders

Figure 6B:
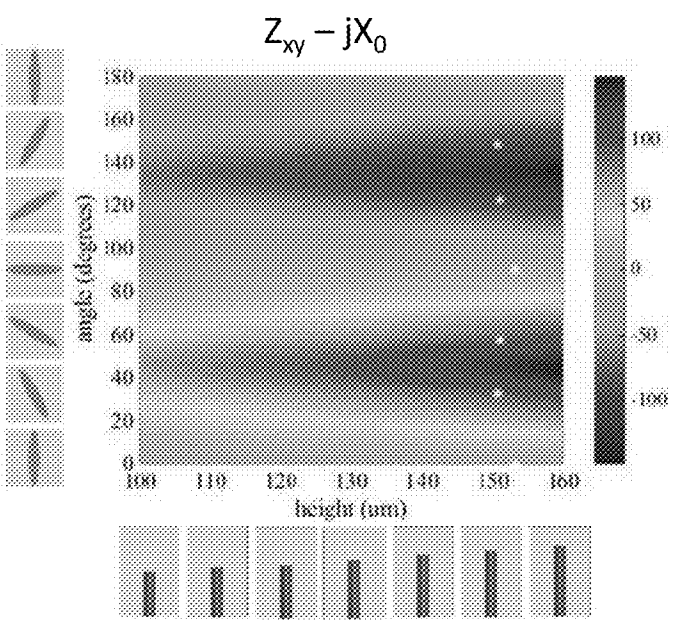
FIG. 6(*a*) illustrates the variation of the Zxx element of the impedance tensor with the height and orientation of the elliptical cylinder, according to one or more embodiments of the present invention ($Z_{xx}=jX_0(1+M\cos(\beta_{sw}\rho))$).
Figure 6A:
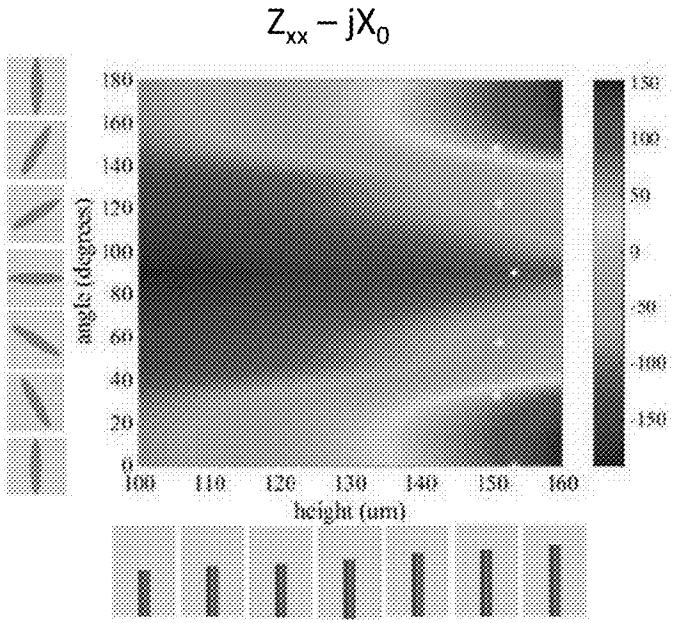

FIG. 6(*a*) illustrates the variation of the Zxx element of the impedance tensor with the height and orientation of an elliptical cylinder.

FIG. 6(*b*) illustrates the variation of the Zxy element of the impedance tensor with the height and orientation of the elliptical cylinder.

Figure 7B:
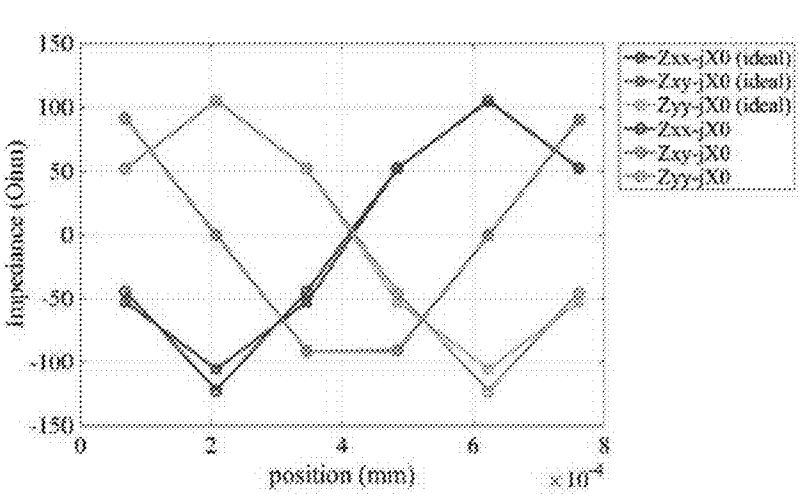
FIG. 7(*a*) illustrates the variation of the Zyy element of the impedance tensor with the height and orientation of the elliptical cylinder, according to one or more embodiments of the present invention ($Z_{yy}=jX_0(1-M\cos(\beta_{sw}\rho))$).
Figure 7A:
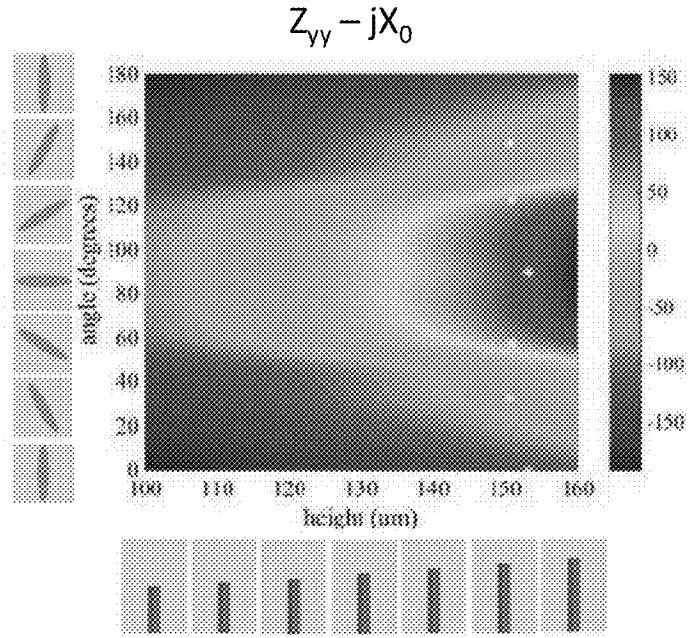

FIG. 7(*a*) illustrates the variation of the Zyy element of the impedance tensor with the height and orientation of the elliptical cylinder.

FIG. 7(*b*) illustrates ideal values of a sinusoidal modulation of the impedance tensor, and values retrieved using the proposed metasurface based on elliptical cylinders.

In FIGS. 6(*a*), 6(*b*), and 7(*a*), and 7(*b*), $X_0=0.7\eta_0$; M=0.4, Nc=6; a=138.5 μm, and $$\beta_{sw} = \frac{2\pi}{N_c a}.$$

Figure 8A:
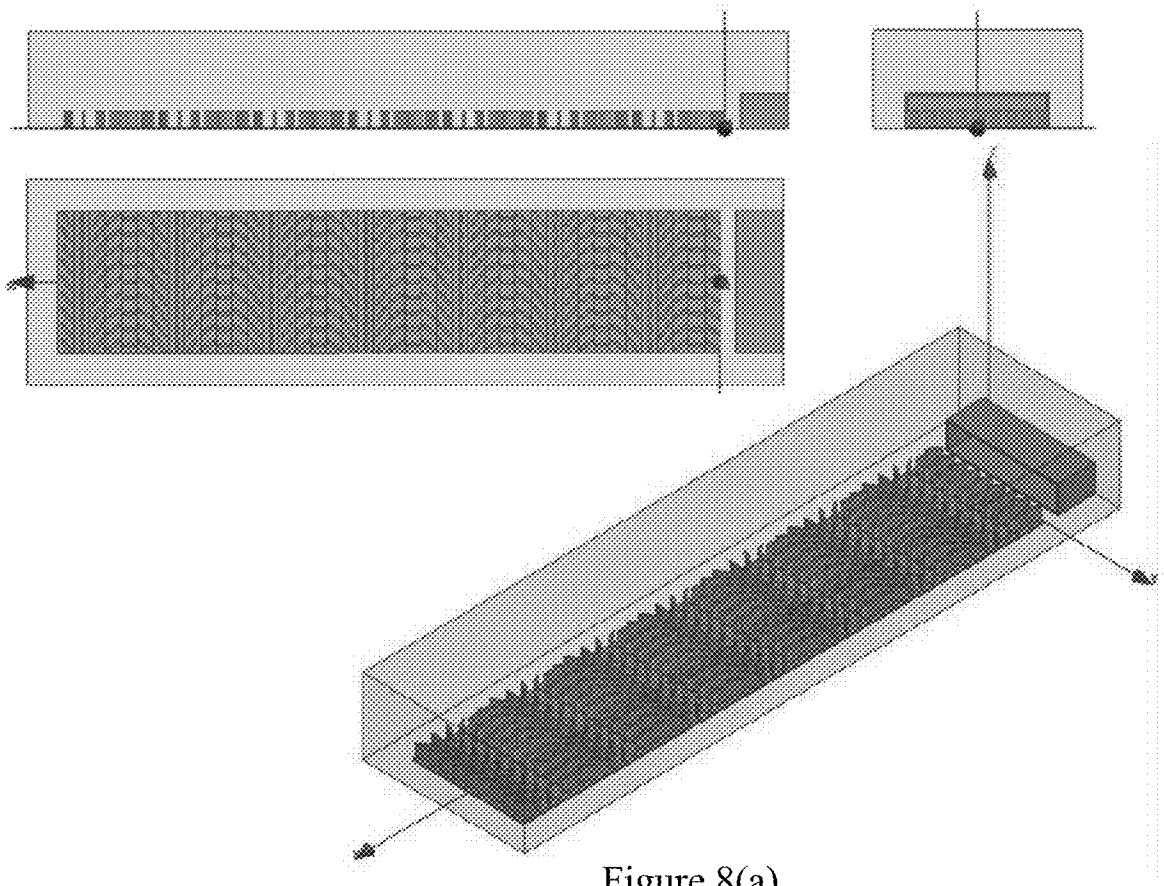
FIG. 8(*a*) illustrates a metasurface strip consisting of elliptical cylinders designed to transform an impinging transverse magnetic (TM) surface wave (SW) into right-handed circular polarization (RHCP), according to one or more embodiments of the present invention.
Figure 8B:
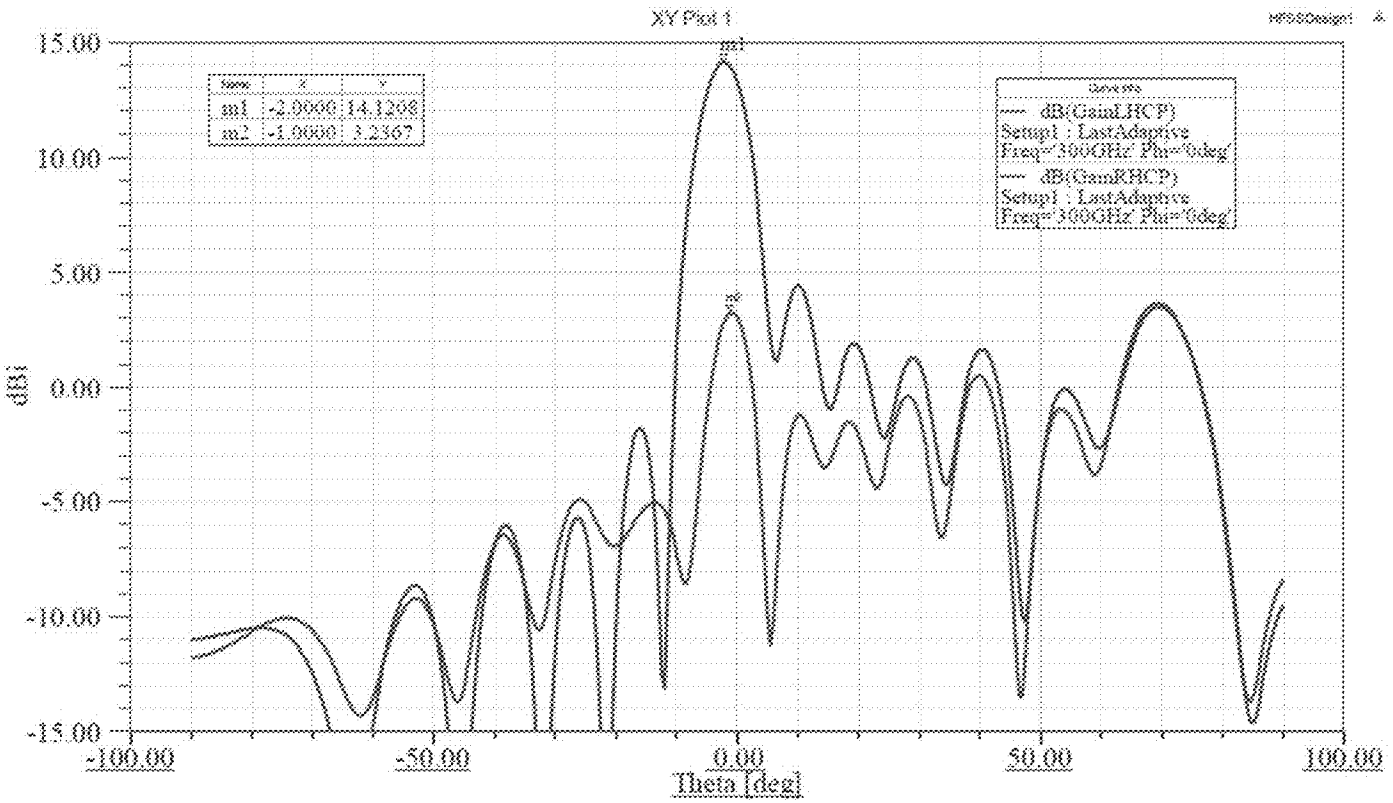
Figures 9A, 9B, 9C, 9D:
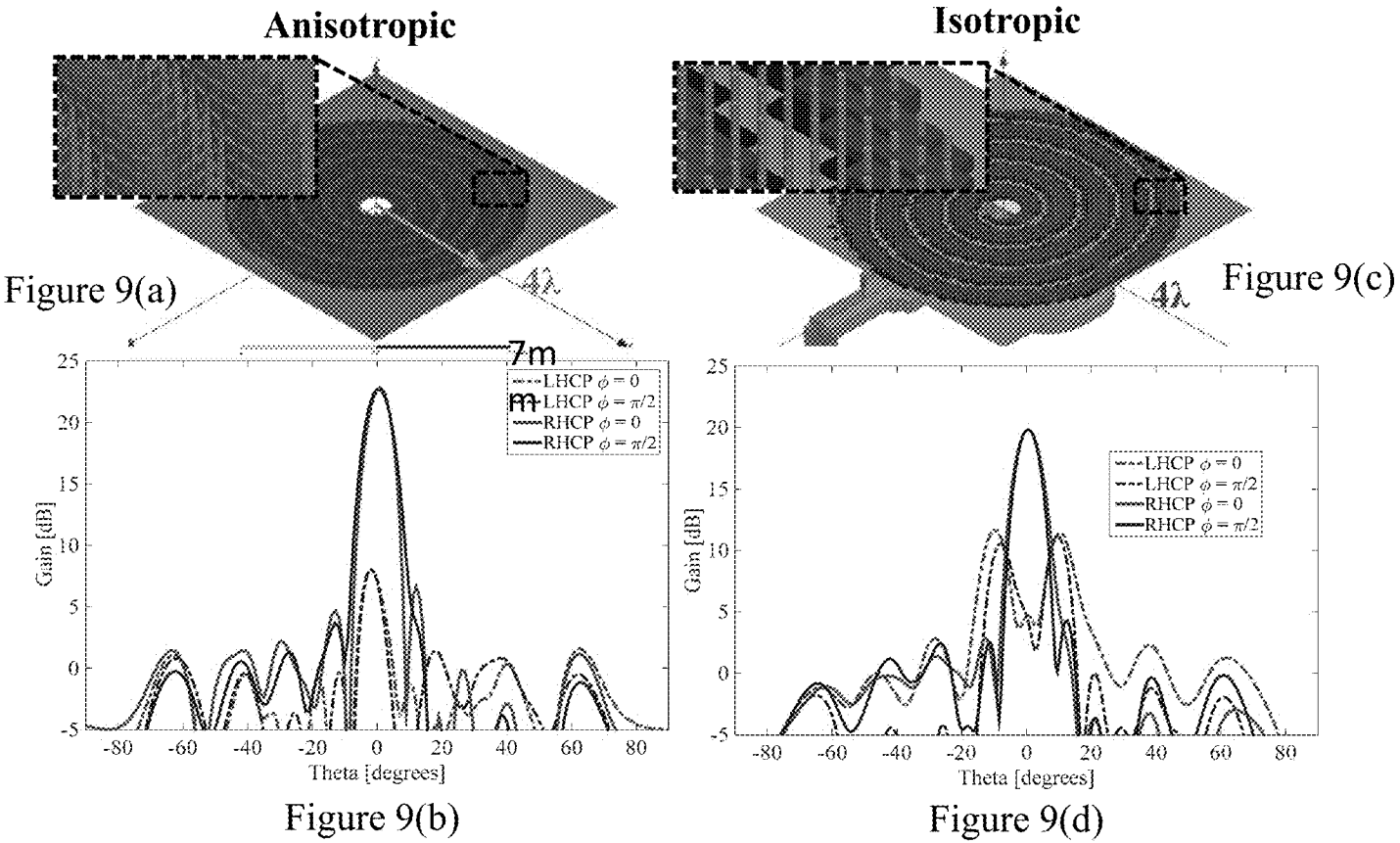
FIG. 9(*a*) illustrates an anisotropic spiral antenna, FIG. 9(*b*) illustrates gain for the anisotropic antenna, FIG. 9(*c*) illustrates an isotropic spiral antenna, and FIG. 9(*d*) illustrates gain for the isotropic spiral antenna, according to embodiments of the invention.
Figure 9E:
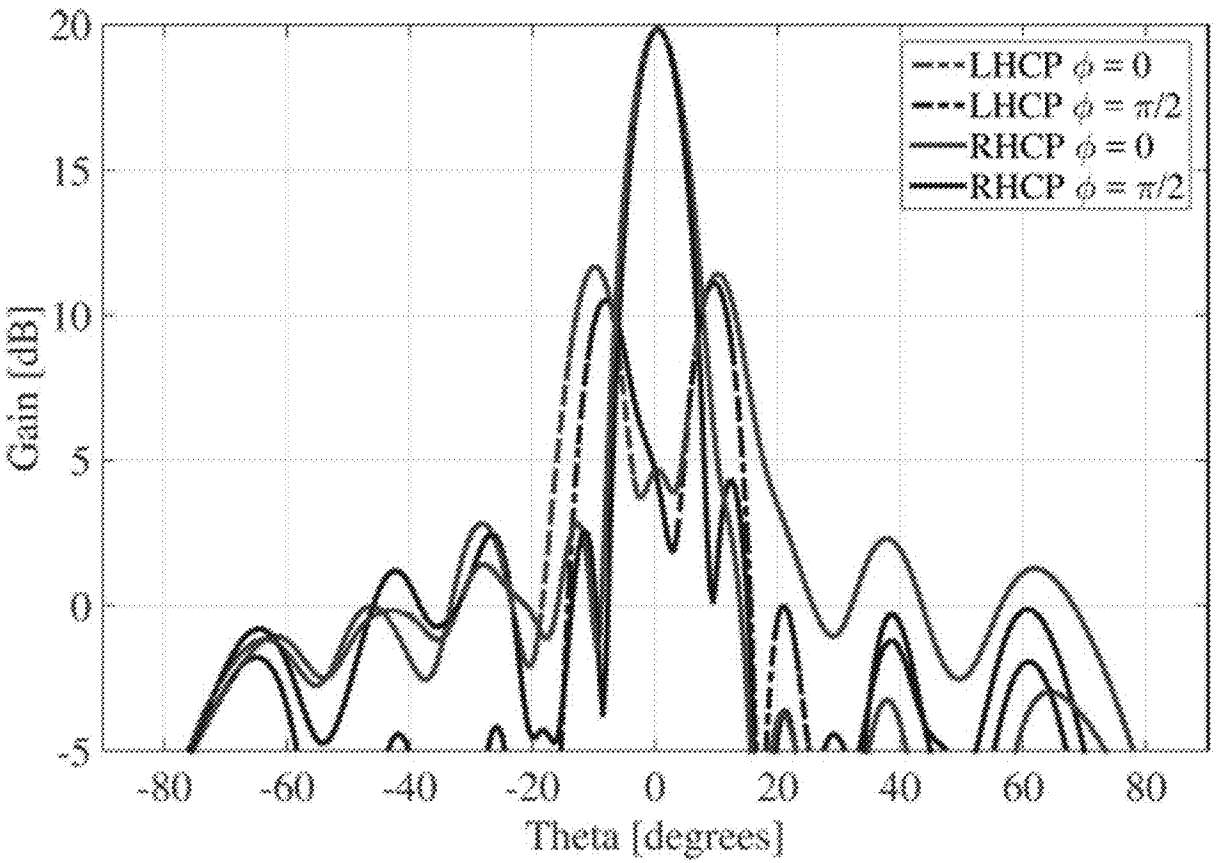
Figure 9F:
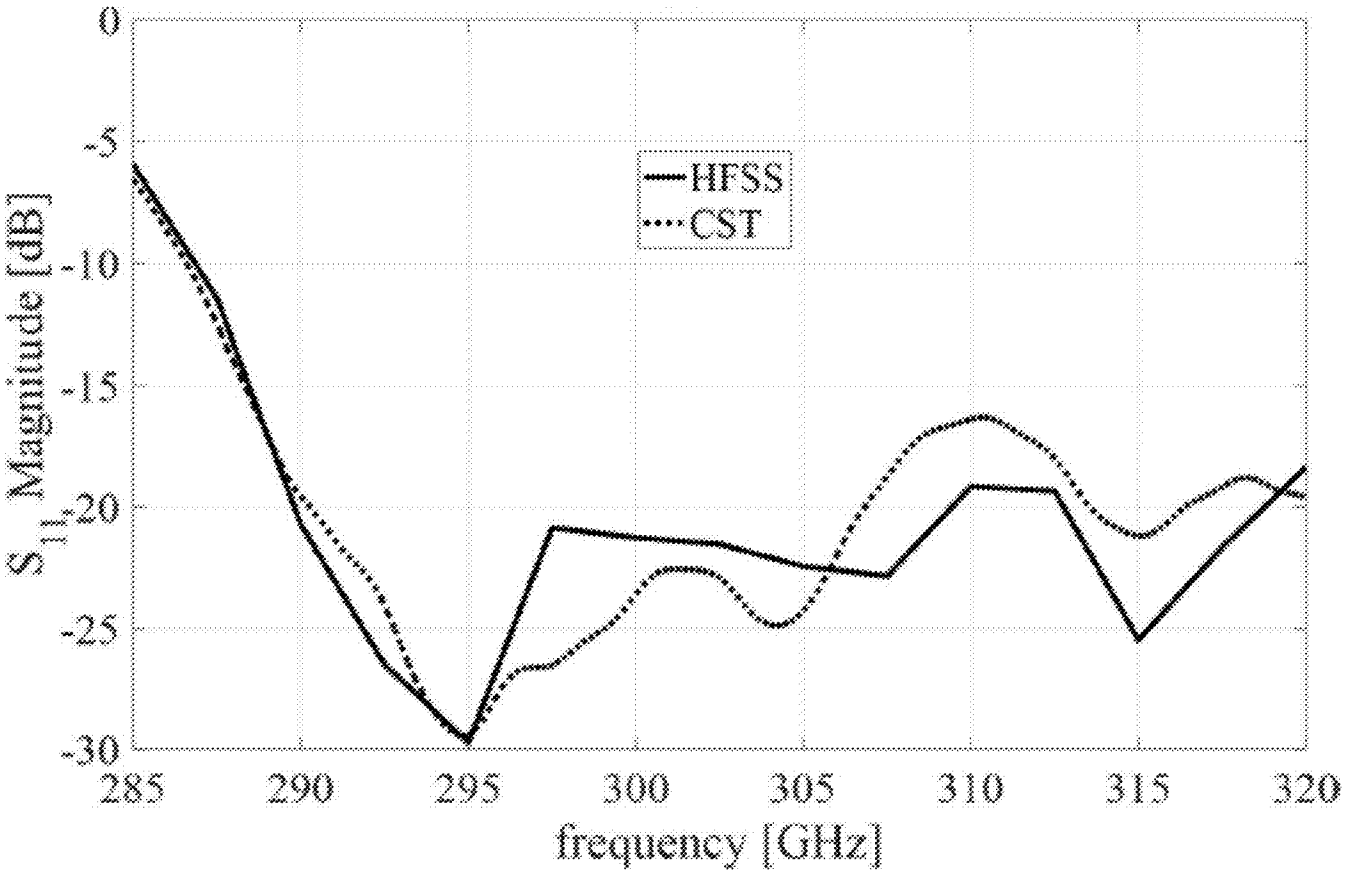
Figure 9G:
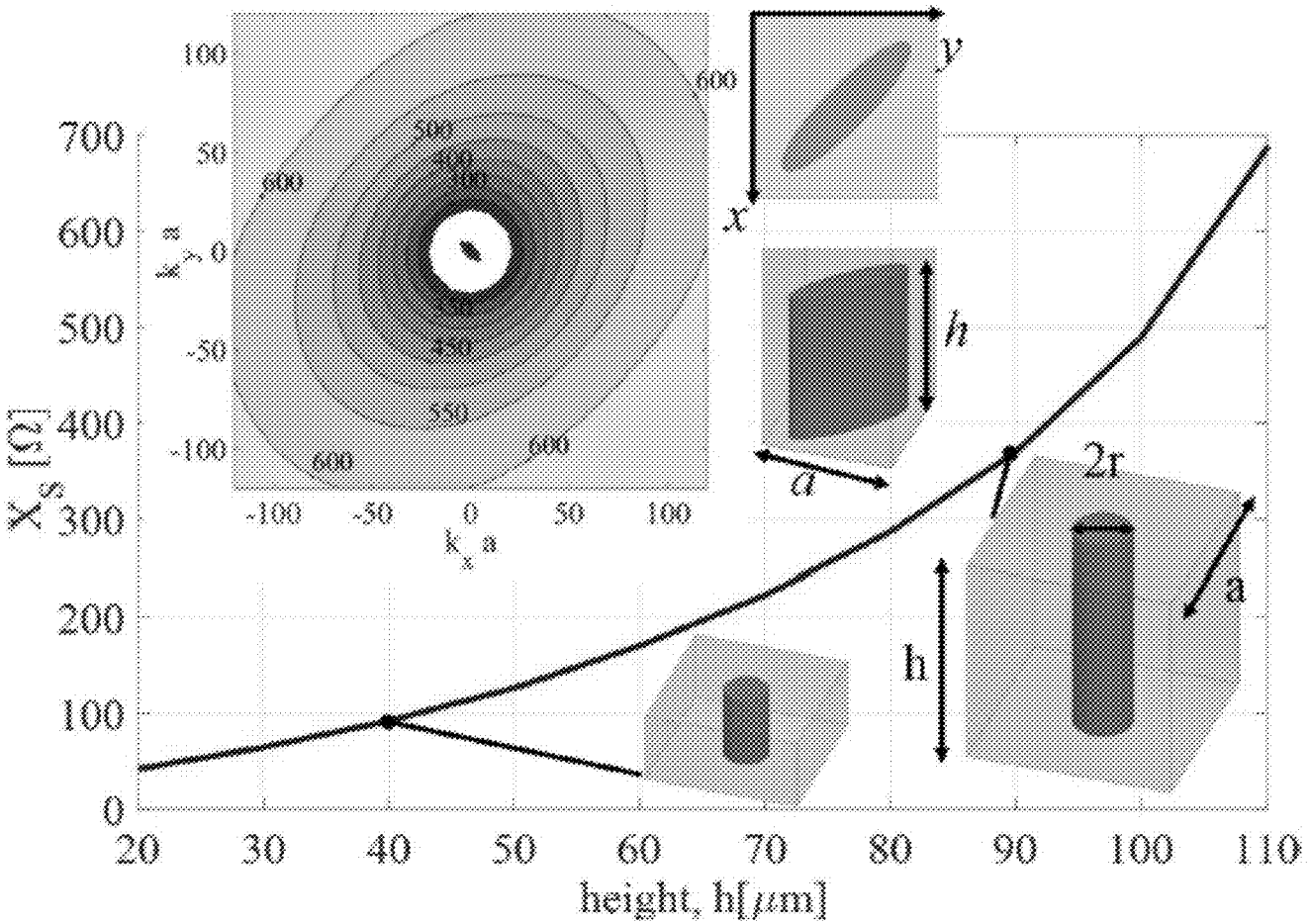
Figure 9H:
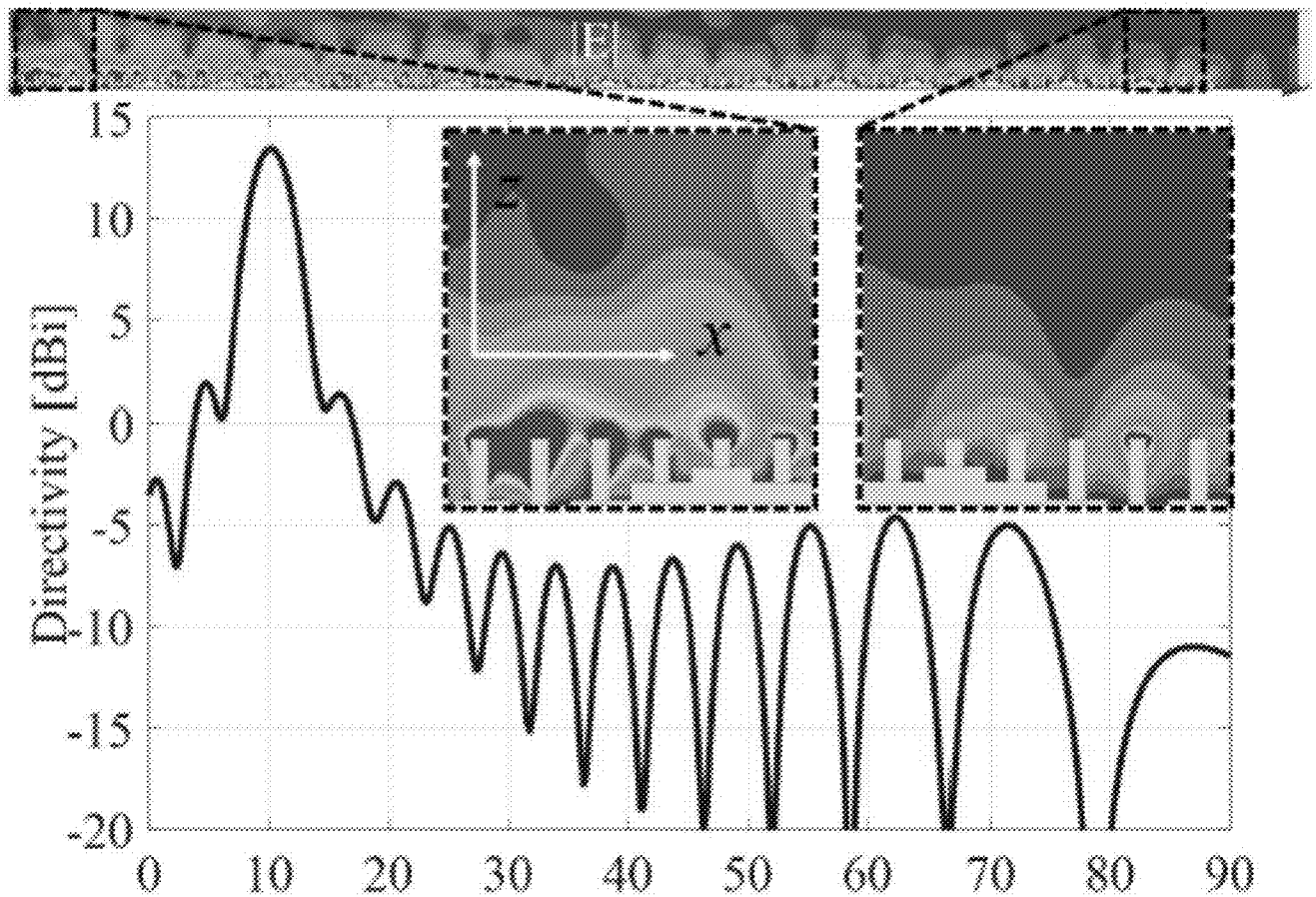

FIG. 8(*a*) illustrates a metasurface strip consisting of elliptical cylinders designed to transform an impinging transverse magnetic (TM) surface wave (SW) into right-handed circular polarization (RHCP).

FIG. 8(*b*) illustrates RHCP fields radiated by the metasurface in FIG. 8(*a*).

FIGS. 9(*a*)-9(*d*) show a comparison between two spiral MTS antennas of identical size (one isotropic, one anisotropic). The antenna and the radiation patterns on the right-hand side are the ones already shown in FIG. 5(*a*) and FIG. 5(*b*), respectively. The antenna in FIG. 9(*a*) has been realized using pillars of elliptical cross-section. By appropriately using the anisotropy provided by the elliptical pillars, one can improve the radiation characteristics obtained with an aperture of the same size by reducing the level of the LHCP component, and by increasing the overall gain of the antenna, as shown in FIG. 9(*b*).

For more general cross-sections, the surface reactance is a tensor that depends on the transverse wave vector.

$$\underline{\beta}_{sw}=\beta_{sw}^{x}\hat{x}+\beta_{sw}^{y}\hat{y}$$

The inset in FIG. 9(*g*) shows the isofrequency dispersion curves for an elliptical cylinder with minor axis equal to 20 μm, axial ratio 4, and in a square unit cell with 86.8 μm side. A major advantage of DRIE is that one can choose to etch complex cross-sections. This feature can be exploited to synthesize anisotropic surface reactances, which provide additional degrees of freedom for controlling the aperture fields' polarization [2, Sec. V]. The simulation consists in a row of cylindrical rods oriented along x. The surface reactance has been modulated and the design frequency is 550 GHz. The value of d at this frequency for the modulation above and a pointing angle $\theta_0=10°$ is d=521 μm. For N=6, one has a=d/N–86:8 μm. The total length of the row is 15λ. The heights of the cylinders that one needs to realize the surface reactance at each unit cell have been retrieved from FIG. 9(*h*) using a local periodicity assumption. The structure is excited by a wave port with vertical electric field, and the row of cylinders is sandwiched by two perfect magnetic planes to maintain a field distribution that supports the TM SW. FIG. 9(*h*) shows the directivity pattern of the structure obtained with HFSS [6], this results confirms the presence of a beam pointing in the desired direction. One can see in the insets the effect of the SW attenuation as it gets radiated along the structure.

Process Steps

Figure 10:
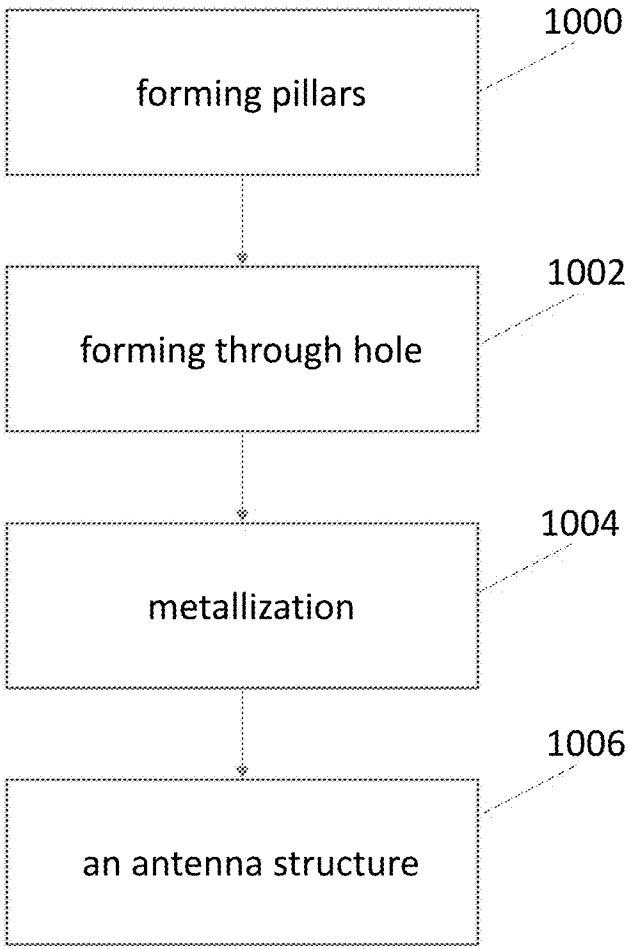
FIG. 10 is a flowchart illustrating a method of fabricating an antenna structure, according to one or more embodiments of the present invention.

FIG. 10 is a flowchart illustrating a method of fabricating an antenna structure.

Block 1000 represents forming (e.g., etching or machining) an array A of structures 1000 (e.g., pillars, columns, posts, or pins) onto a substrate 500.

Examples of substrates 500 include, but are not limited to, a semiconductor (e.g., silicon) or a metal block (e.g., aluminum block).

In one embodiment, a multi-step DRIE process is used where multiple patterns of different depths are etched into a (e.g., $SiO_2$) mask layer deposited on a semiconductor wafer 500 (e.g., silicon). The different depths in the mask layer allow different depths of etching into the semiconductor wafer, and thereby enable manufacture of pillars of varying height. A series of etching steps are then performed, comprising (1) etching the mask to expose one or more respective regions of semiconductor wafer beneath the thinnest remaining $SiO_2$ pattern, and then (2) etching the semiconductor wafer below all of said exposed respective regions to obtain a multi depth structure comprising the array of pillars having varying height.

Block 1002 represents an optional etching/machining step to form a through hole 502 in (e.g., a center of) the substrate/wafer 500.

Block 1004 represents an optional metallization step, wherein the structure (including the circular waveguide, i.e., the through hole 502 at the center) and the pillars 1000 are metalized, e.g., by depositing metal M (e.g., gold) on the surfaces of the pillars 1000 and the inner surface of the hole 502. Sputtering may be used to deposit the metal. In one or more embodiments, the thickness of the metal (e.g., gold) is in a range of 1-20 microns, e.g., 2 microns. In one or more embodiments, a ground plane is deposited (e.g., on a backside of the wafer). The antenna embodiments comprising a feed integrated on the aperture plane are less complex compared to deployable classical reflectors or reflectarray antennas, thereby substantially reducing the risk of failure.

The antenna may be excited with a feed that is compatible with the rectangular waveguide output of a solid-state frequency multiplied source.

Silicon micromachined components have been recently shown to provide an excellent performance in the submillimeter wave range [4]. Among the existing techniques, DRIE is particularly well-adapted for micromachining integrated front-ends. Since it is based on etching, one may argue that it is challenging to maintain straight sidewalls and uniform depth across the wafer for each depth step. Nevertheless, these drawbacks can be overcome by extensive process development [5] and a thorough design (e.g. selecting the heights of the pillars to be more than 10 times their radius). In one or more DRIE embodiments fabricating a spiral antenna, the cylinder's heights are sampled so to have just four etching steps.

In one or more embodiments, a Si wafer and DRIE are used to meet the accuracy required at THz frequencies, but at lower frequencies the structure can be a machined solid aluminum block with the pillars (e.g., cylinders) on one side. By using a fully metallic structure, the losses of conventional dielectric substrates in the sub-millimeter wave range may be overcome. However, the designs presented herein also open up the possibility of realizing anisotropic impedance boundary conditions with all-metallic structures at THz frequencies.

Figure 11:
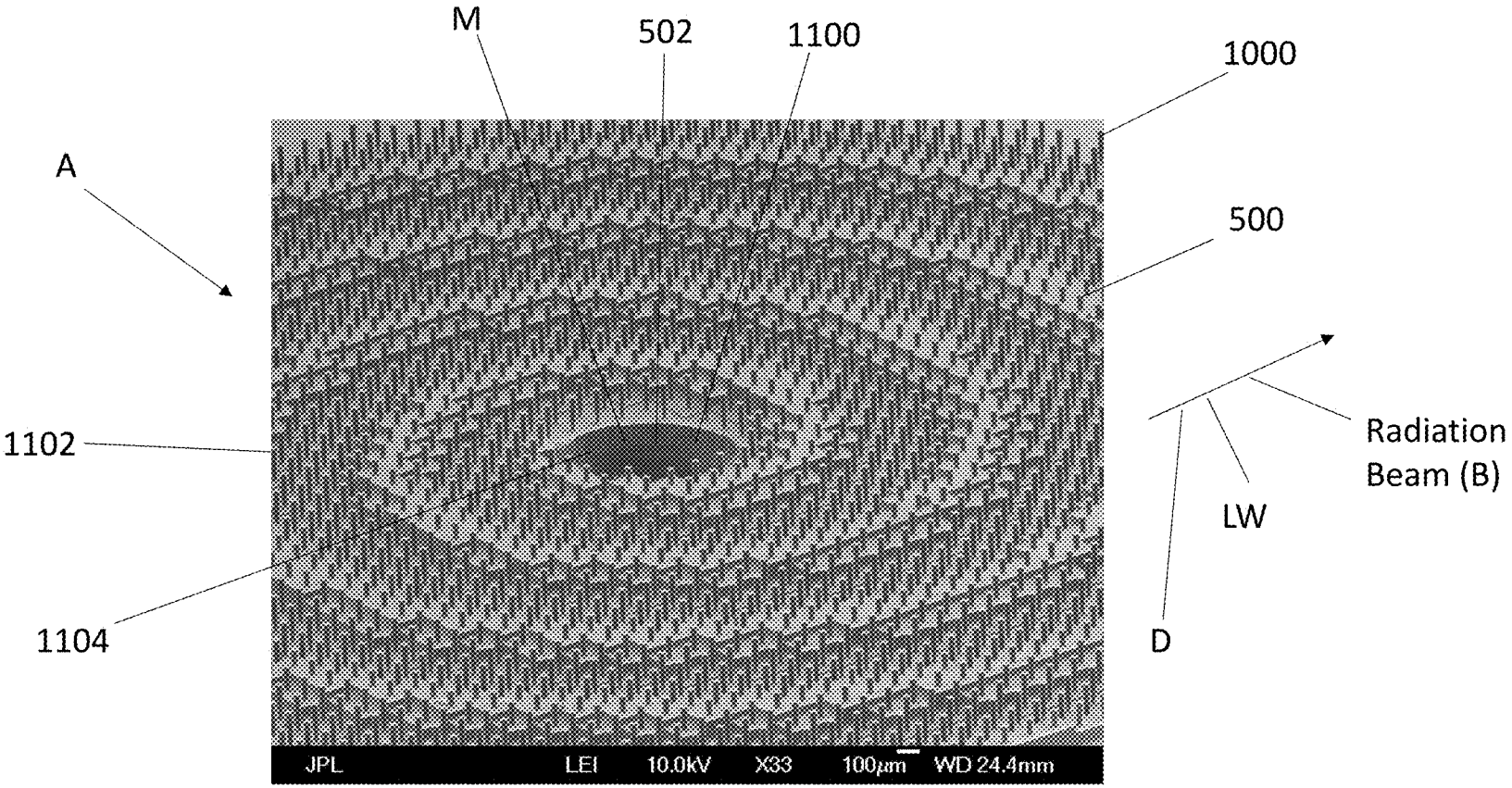
FIG. 11 is an SEM image of a DRIE fabricated MTS antenna structure, according to one or more embodiments of the present invention.

Block 1004 represents (and FIGS. 5*a* and 11 illustrate) the end result, an antenna structure comprising an array A pillars 1000 formed on a substrate 500, wherein a height h of the pillars 1000 varies across the array A so that a surface-wave (SW) propagating on the substrate is transformed into a leaky wave (LW) that radiates from the array A. FIG. 11 illustrates a DRIE fabricated spiral antenna structure comprising through hole 502 for the antenna feed 1100 on the aperture plane 1102. The feed waveguide comprises the hole 502 in the substrate 500 and metal M deposited on an inner surface 1104 of the hole 502.

To better illustrate the antenna structures and methods disclosed herein, a non-limiting list of examples is provided here:

In Example 1, the pillars have a height h up to 2000 micrometers, a diameter (2r) or width in a range of 1 micrometer-1000 micrometers, and a spacing S in a range of 50 micrometers to 2000 micrometers. The maximum height and diameter of the cylinders, and the maximum pitch of the (e.g., square) lattice typically correspond to the frequency range of interest. A broad range of MTS modulation may be achieved by changing the height or radius of the pillars (e.g., with a unit cell with constant dimensions).

In Example 2, the subject matter of Example 1 further optionally includes the height h of each pillar 1000 being less than 10 times a radius r of the pillar 1000.

In Example 3, the subject matter of any combination of Examples 1-2 optionally include the heights h varying periodically across the array A so that a surface reactance (e.g., $X_s$) of the substrate 500 is modulated across the array A and the leaky wave LW radiates as a beam B of electromagnetic radiation. For example, the heights can vary periodically so that a power in the beam at an angle of more than 10 degrees, from a center direction D of propagation of the beam B, is reduced by a factor of at least 10. In yet a further example, the heights h of the pillars 1000 vary periodically across the array with a period in a range of 50-200 micrometers. Various pointing angles (e.g., 1 degree, 5 degrees, 10 degrees, may be achieved).

In Example 4, the subject matter of any combination of Examples 1-3 optionally include the array A having a length L and width W in a range of 1 mm-1 m.

In Example 5, the subject matter of any combination of Examples 1-4 optionally include the heights h and one or more spacings S of the pillars 1000 being such that the leaky wave LW radiating from the array A has the desired frequency (e.g., in a range of 2 GHz-1000 THz, in a range of 275-350 GHz, or in a Ka band (26.5-40 GHz), e.g., 32 GHz) or desired wavelength (e.g., a submillimeter or millimeter wavelength).

In Example 5, the subject matter of any combination of Examples 1-5 optionally include the pillars 1000 and the substrate 500 comprising a semiconductor (e.g., silicon). The semiconductor in the pillars 1000 is coated with metal M and the pillars are etched onto a surface of the substrate 500.

In Example 6, the subject matter of any combination of Examples 1-5 optionally include the substrate and the pillars consisting essentially of metal (e.g., machined from a metal block).

In one or more embodiments, the antenna structure is integrated into a telecommunications device, such as a Cubesat or Smallsat, and the pillar architecture is designed to meet the requirements of the telecommunications system. In one example, the antenna comprises a metal pin antenna that provides high directivity, is low-profile, and is integrated in a cubesat wall. Not only does the metal pin antenna conform to CubeSat/SmallSat requirements, but it also maintains performances comparable to classical reflector systems.

However, the terahertz or gigahertz antennas described herein are suitable for many applications including, but not limited to, any terahertz/gigahertz instruments that require high directivity antennas and that require ease of fabrication.

Space Borne Antenna Examples

The key features for space-borne terahertz antennas are compact size, low volume, low-profile, and high directivity. This is especially critical now as technology moves into the small-sat and cubesat area (in recent years, CubeSats have also been proposed for immediately relaying critical data to the Deep Space Network during entry, descent, and landing (EDL). However, for a low-frequency (Ka-band) application, adapting high-gain telecommunication antennas to CubeSats/SmallSats platforms has proved to be a great challenge. The mass of a Ka-band telecommunication system is typically dominated by the metallic antenna structure. For instance, the high-gain antenna in the Mars Reconnaissance Orbiter (MRO) is a 3-meter-diameter dish weighing 21-kg.

State-of-the-art alternatives lie in deployable Cassegrain antennas, with deployable primary reflector, and reflectarrays, as done up to Ka band for deep space communications (e.g., Mars Cube One or RainCube). These approaches have greatly reduced the overall mass and it is indeed complicated to fulfill the link budget without using deployable elements. However, while deployable antennas which can be folded inside a Cubesat during launch and deployed in space work well at low frequencies, the surface accuracy requirement is too challenging at terahertz frequencies. Moreover, while horn antennas are mostly used at terahertz frequencies, horn antennas are long and require complicated machining at terahertz frequencies. Thus, alternative solutions where low profile antennas can be integrated to cubesat walls are needed.

The metasurface antennas according to embodiments of the present invention provide the alternate technology that accomplishes the same objectives without the need for deploying the reflector (or reflectarray) feed and with a substantially lower complexity and risk. Embodiments of the novel MTS antennas described herein have compact size, low volume, low-profile, and high directivity suitable for use in space borne applications while at the same time having high gain and ease of fabrication. Thus, embodiments of the MTS antennas described herein are easily integrated in a cubesat platform, for example.

Wireless Communication Examples

Figures 12A, 12B, 12C, 12D, 12E:
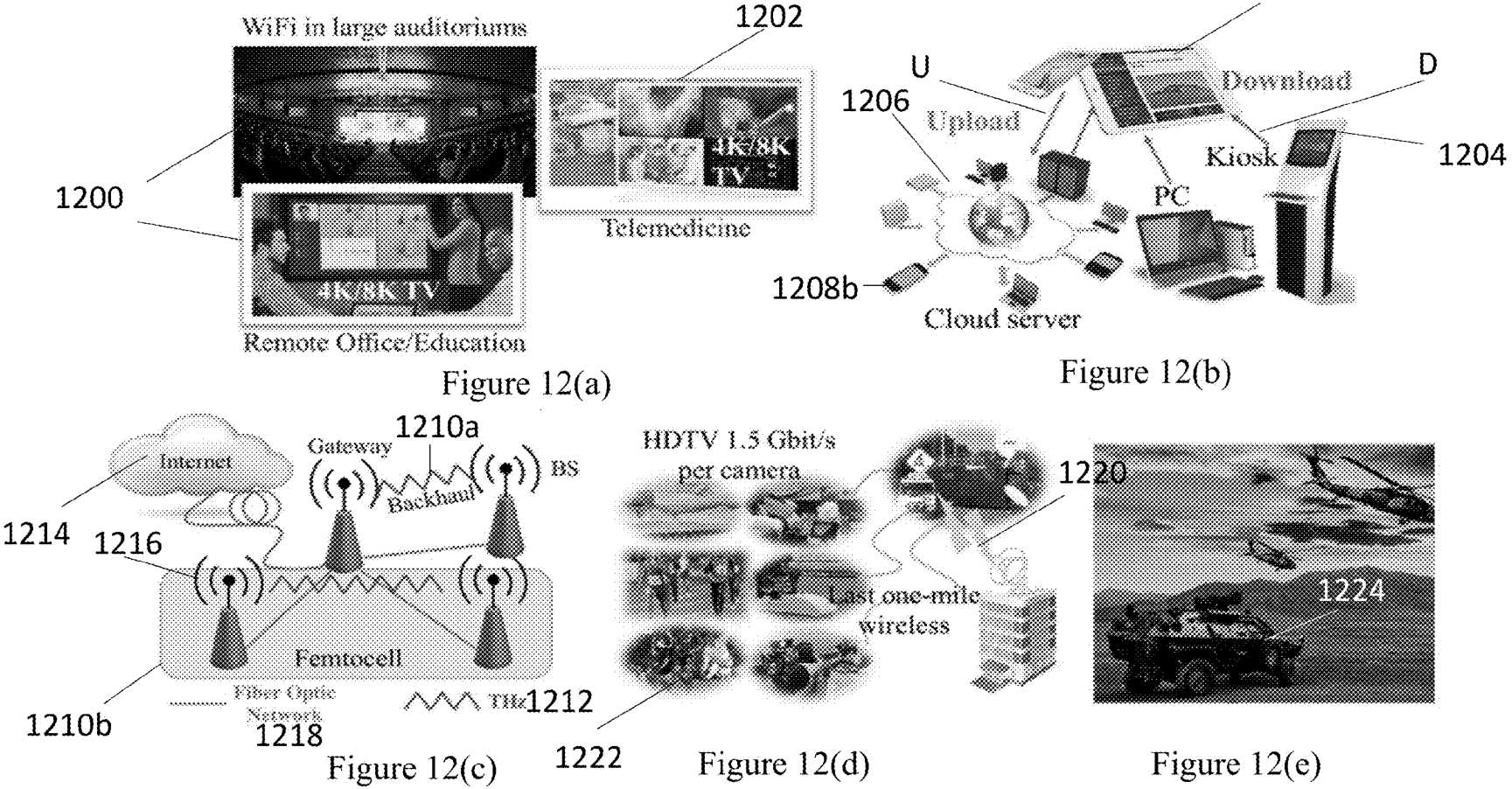
FIGS. 12(*a*)-12(*e*) illustrate wireless communication systems that may incorporate MTS antennas according to one or more embodiments of the invention.

In recent years, THz wireless communications have attracted a lot of attention due to the increasing bandwidth (BW) required by modern wireless communication systems [13]-[17]. The trend in the electronics consumer market is to transfer ever-increasing amount of information wirelessly. For instance, the new ultra high definition (HD) standard for video (also known as 4K) has doubled the image resolution of current HD. Simultaneously, future mobile services (5G and beyond 5G) are driven by the users demand for higher data rates, up to hundreds of Gb/s. Wireless data traffic is thus exponentially growing by a factor of 10 every 5 years [18]. As detailed in the Ericsson Mobility Report [19], it is expected that mobile communications will lead the increase of data traffic, with video accounting for 70% of global mobile data traffic by 2021. This growth implies that, in about 10 years from now, we will need data rates of hundreds of Gb/s (Tb/s according to [20]), a large number of short-range wireless networks, and links to connect densely distributed femto base-stations. It is an accepted fact that 5G and beyond 5G systems will need carrier frequencies in the sub-THz regime (between 100 GHz and 1 THz) where larger BWs can be obtained [13]-[17]. FIGS. 12(*a*)-12(*e*) show some systems in need of this large BW (and which can use the MTS antenna described herein in a transmitter to transmit THz and/or in a receiver to receive the THz).

FIG. 12(*a*) shows ultra-high-speed wireless networks for streaming of ultra-high-definition multimedia in wireless local area networks (WLAN) or wireless personal area networks (WPAN) for smart offices (e.g., remote office, education institutions, WIFI in large auditoriums) and smart homes 1200, respectively, and telemedicine 1202.

FIG. 12(*b*) illustrates wireless short range interconnection of devices, such as kiosk 1204 downloading D, wireless connections (uploading U and downloading D) in data centers (e.g., cloud servers 1206), and device-to-device (D2D) communications between personal computers (PC) and tablets 1208*a* or other mobile devices 1208*b*.

FIG. 12(*c*) illustrates front- and backhauling 1210 of base stations (BS) in femto-cells; point-to-point THz wireless links 1212 can reduce deployment costs. The THz may be used to transmit internet 1214 to gateway stations 1216 and the THz links 1212 may be connected to a fiber optic network 1218.

FIG. 12(*d*) illustrates broadcasting of "uncompressed" HDTV channels (e.g., 1.5 Gbit per camera) using THz links 1220 for real-time conversations and images/video 1222, e.g., for last one-mile wireless.

FIG. 12(*e*) illustrates secure wireless communication between vehicles 1224 for military and defense applications. The high atmospheric attenuation in the THz range can be used to limit the eavesdropping probability and create secure channels.

The use of frequencies between 275 and 350 GHz is the key to enable (even with simple modulation schemes) the ultra-large BWs required by the applications above, owing to the following advantages:

- The 275-350 GHz frequency range has not yet been allocated: it is thus very attractive for wireless links with high data rates in unregulated bands. Moreover, according to IEEE Standard 802.15.3 [21], the 252-325 GHz band can be used for wireless peer-to-peer communications.
- The 275-350 GHz band presents several atmospheric attenuation windows below 10 dB/Km 0, which enable mid-range links (important for mobile wireless backhaul) and small cell deployment.
- The free-space wavelength at 300 GHz is around 1 mm, which makes feasible the design of on-chip antennas. On-chip approaches favor integration and packaging, one can thus get rid of interface losses and costly precision assembly steps, which is a huge advantage for antennas in portable devices.
- THz wireless links have higher tolerance in alignment and present losses more than two orders magnitude lower than Optical Wireless Communications (OWC) [13], [22] in foggy conditions. Indeed, OWC links are very susceptible to atmospheric environment conditions such as air turbulence and humidity fluctuation (the scintillation effect), fog, smoke, and rain [13].

Further information on one or more embodiments of the present invention may be found in [23-24].

REFERENCES

The following references are incorporated by reference herein.

[1] B. Fong, J. Colburn, J. Ottusch, J. Visher, and D. Sievenpiper, "Scalar and tensor holographic artificial impedance surfaces," IEEE Trans. Antennas Propag., vol. 58, no. 10, pp. 3212-3221, October 2010.

[2] G. Minatti, M. Faenzi, E. Martini, F. Caminita, P. De Vita, D. Gonz alez-Ovejero, M. Sabbadini, and S. Maci, "Modulated metasurface antennas for space: Synthesis, analysis and realizations," IEEE Trans. Antennas Propag., vol. 63, no. 4, pp. 1288-1300, April 2015.

[3] G. Chattopadhyay, "Technology, capabilities, and performance of low power terahertz sources," IEEE Trans. THz Sci. Technol., vol. 1, no. 1, pp. 33-53, September 2011.

[4] T. Reck, C. Jung-Kubiak, J. Gill, and G. Chattopadhyay, "Measurement of silicon micromachined waveguide components at 500-750 GHz," IEEE Trans. THz Sci. Technol., vol. 4, no. 1, pp. 33-38, January 2014.

[5] C. Jung, B. Thomas, C. Lee, A. Peralta, J. Gill, K. Cooper, G. Chattopadhyay, E. Schlecht, R. Lin, and I. Mehdi, "Compact submillimeter-wave receivers made with semiconductor nano-fabrication technologies," in Proc. IEEE Int. Microw. Symp. (IMS), June 2011, pp. 1-4.

[6] A. Oliner and A. Hessel, "Guided waves on sinusoidally-modulated reactance surfaces," IRE Trans. Antennas Propag., vol. 7, no. 5, pp. 201-208, December 1959.

[7] R. King, D. V. Thiel, and K. Park, "The synthesis of surface reactance using an artificial dielectric," IEEE Trans. Antennas Propag., vol. 31, no. 3, pp. 471-476, May 1983.

[8] M. Silveirinha, C. Fernandes, and J. Costa, "Electromagnetic characterization of textured surfaces formed by metallic pins," IEEE Trans. Antennas Propag., vol. 56, no. 2, pp. 405-415, February 2008.

[9] ANSYS Inc., "HFSS, Version 15," Pittsburgh, Pa., 2015, CST of America, "CST Microwave Studio," Anaheim, Calif., 2016.

[10] M. Esquius-Morote, J. Gomez-Diaz, and J. Perruisseau-Carrier, "Sinusoidally modulated graphene leaky-wave antenna for electronic beamscanning at thz," IEEE Trans. THz Sci. Technol., vol. 4, no. 1, pp. 116-122, January 2014.

[11] H. Bilow, "Guided waves on a planar tensor impedance surface," IEEE Trans. Antennas Propag., vol. 51, no. 10, pp. 2788-2792, October 2003.

[12] D. Gonz alez-Ovejero and S. Maci, "Gaussian ring basis functions for the analysis of modulated metasurface antennas," IEEE Trans. Antennas Propag., vol. 63, no. 9, pp. 3982-3993, September 2015.

[13] J. Federici and L. Moeller, "Review of terahertz and subterahertz wireless communications," *J. Appl. Phys.*, vol. 107, no. 11, 2010.

[14] T. Kleine-Ostmann and T. Nagatsuma, "A review on terahertz communications research," *J. Infrared Milli Terahz Waves*, vol. 32, no. 2, pp. 143-171, 2011.

[15] H.-J. Song and T. Nagatsuma, "Present and future of terahertz communications," *IEEE Trans. THz. Sci. Technol.*, vol. 1, no. 1, pp. 256-263, September 2011.

[16] G. Ducournau, et al. "THz Communications using Photonics and Electronic Devices: the Race to Data-Rate, "*J. Infrared Milli Terahz Waves*, vol. 36, no. 2, pp. 198-220, 2015.

[17] T. Nagatsuma, G. Ducournau, and C. C. Renaud, "Advances in terahertz communications accelerated by photonics" *Nature Photon*. vol. 10, pp. 371-379, 2016.

[18] Y. Neuvo, "Unfogging the future," Plenary Talk at *IEEE Eur. Microw. Conf.*, Amsterdam, The Netherlands, Oct. 28-Nov. 2, 2012.

[19] "Ericsson Mobility Report, on the pulse of the Networked society", June 2016.

[20] R. Aguiar et al., "White paper for Research Beyond 5G", available at "http://networld2020.eu/wp-content/uploads/2016/03/B5G-Vision-for-Researchv-1.1b_final-and-approved.pdf, October 2015.

[21] Task Group 3d 100 Gbit/s Wireless TG 3d (100G); available at "http://www.ieee802.org/15/pub/index_TG3d.html."

[22] L. Moeller, K. Su, R. Barat, and J. F. Federici, "THz and IR signaling through fog scintillations", *Proc. Eur. Wireless*, Poznan, Poland, Apr. 18-20, 2012, pp. 1-5.

[23] D. González-Ovejero, T. J. Reck, C. D. Jung-Kubiak, M. Alonso-DelPino and G. Chattopadhyay, "Silicon micromachined modulated metasurface antennas in the Terahertz range," presented at 10th Eur. Conf. Antennas Propag., pp. 1-4, Davos, Apr. 10-15, 2016 (not available online).

[24] D. González-Ovejero, T. J. Reck, C. D. Jung-Kubiak, M. Alonso-DelPino and G. Chattopadhyay, "A class of silicon micromachined metasurface for the design of high-gain terahertz antennas," in Proc. IEEE AP Soc. Int. Symp., pp. 1191-1192, Fajardo, PR, June-July 2016.

[26] US Patent Pub. No. 2014/0340178.

CONCLUSION

This concludes the description of the preferred embodiment of the present invention. The foregoing description of one or more embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An antenna structure, comprising:

an array of at least 1000 pillars formed on a substrate and defining unit cells, wherein:

a height of each pillar is less than 10 times a radius of the pillar, and the height and/or orientation of the pillars varies periodically across the array with a period of at least 200 micrometers so as to realize a surface reactance at each of a plurality of the unit cells across the array needed to transform a surface-wave (SW) propagating through the array into a leaky wave (LW) that radiates from the array in a desired direction; and a circular feed waveguide coupled to the array so as to input a transverse magnetic mode exciting the SW.

2. The antenna structure of claim 1, wherein the pillars comprise cylinders having a circular, square, or elliptical cross-section.

3. The antenna structure of claim 1, wherein the antenna structure does not include partially reflecting surfaces and the heights and/or the orientations vary periodically across the array so that the surface reactance of the substrate is modulated across the array and the leaky wave radiates as a beam of electromagnetic radiation.

4. The antenna structure of claim 3, wherein the heights and/or orientations vary periodically so that a power in the beam at an angle of more than 10 degrees, from a center direction of propagation of the beam, is reduced by a factor of at least 10.

5. The antenna structure of claim 1, wherein the pillars and the substrate comprise a semiconductor.

6. The antenna structure of claim 4, wherein the substrate and the pillars comprise silicon.

7. The antenna structure of claim 6, wherein the pillars comprise silicon coated with metal.

8. The antenna structure of claim 5, wherein the pillars are etched onto a surface of the substrate.

9. The antenna structure of claim 1, wherein the substrate and the pillars consist essentially of metal.

10. The antenna structure of claim 1, wherein the pillars have:

a height up to 2000 micrometers, a diameter in a range of 1 micrometer-1000 micrometers, and a spacing between pillars in a range of 50 micrometers to 2000 micrometers or in a range such that the leaky wave radiating from the array has a frequency in a range of 2 GHz-1 THz.

11. The antenna structure of claim 10, wherein the array has a length and width in a range of 1 mm-1 meter.

12. The antenna structure of claim 1, wherein the heights and one or more spacings of the pillars are such that the leaky wave radiating from the array has a frequency in a range of 2 GHz-1 THz.

13. The antenna structure of claim 1, wherein the heights and spacing of the pillars are such that the leaky wave radiating from the array has a submillimeter or millimeter wavelength.

14. The antenna structure of claim 1, wherein the circular feed waveguide is on an aperture plane of the substrate and does not protrude a plane defined by a base of the pillars so that a z coordinate of an aperture of the feed waveguide and the base of pillars are the same.

15. A method of fabricating an antenna structure, comprising:

etching or machining an array of at least 1000 pillars onto a substrate, wherein:

the pillars define a plurality of unit cells across the array, a height of each pillar is less than 10 times a radius of the pillar, and a height of the pillars varies periodically across the array with a period of at least 200 micrometers, so as to realize a surface reactance at each of the plurality of the unit cells needed to transform a surface-wave (SW) propagating on the substrate into a leaky wave that radiates from the array in a desired direction; and coupling a circular feed waveguide to the array so as to input a transverse magnetic mode exciting the SW.

16. The method of claim 15, wherein the substrate comprises silicon.

17. The method of claim 15, wherein the etching comprises deep reactive ion etching.

18. The method of claim 15, wherein the circular feed waveguide comprises a hole in the substrate and metal deposited on an inner surface of the hole.

19. The antenna structure of claim 3, wherein:

the LW comprises a (−1) indexed Floquet mode, the heights vary periodically across the array so that the surface reactance is modulated and the (−1) indexed Floquet mode is a radiative mode.

20. The antenna structure of claim 1, further comprising the circular feed waveguide symmetrically fed by two rectangular waveguides.

21. The antenna structure of claim 1, wherein the pillars have an elliptical cross-section and an orientation of the pillars varies so as to further modulate the surface reactance.

* * * * *